US012152202B2

(12) United States Patent
Beswick et al.

(10) Patent No.: US 12,152,202 B2
(45) **Date of Patent: *Nov. 26, 2024**

(54) FCC PROCESSING WITH REDUCED $CO_2$ EMISSIONS

(71) Applicants: EXXONMOBIL TECHNOLOGY AND ENGINEERING COMPANY, Annandale, NJ (US); Petrochemical Research Institute, Lanzhou (CN)

(72) Inventors: Colin Lee Beswick, Lebanon, NJ (US); Bing Du, Annandale, NJ (US); Daniel J. Garcia, Annandale, NJ (US); Hyung Rae Kim, Basking Ridge, NJ (US); Prateek Mehta, Annandale, NJ (US); Arun K. Sharma, Hellertown, PA (US); Xiaochun Xu, Annandale, NJ (US); Masaaki Sugita, Woodlands, TX (US); William J. Knaeble, Annandale, NJ (US); Zhiyan Wang, Woodlands, TX (US)

(73) Assignees: EXXONMOBIL TECHNOLOGY AND ENGINEERING COMPANY, Spring, TX (US); Petrochemical Research Institute, Lanzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/091,127

(22) Filed: Dec. 29, 2022

(65) Prior Publication Data

US 2024/0218264 A1 Jul. 4, 2024

(51) Int. Cl.
*C10G 11/00* (2006.01)
*C10G 11/18* (2006.01)

(52) U.S. Cl.
CPC ..... *C10G 11/182* (2013.01); *C10G 11/187* (2013.01); *C10G 2300/1011* (2013.01);
(Continued)

(58) Field of Classification Search
CPC ..... C10G 11/182; C10G 11/187; C10G 2300/1011; C10G 2300/1074;
(Continued)

(56) References Cited

U.S. PATENT DOCUMENTS 3,702,886 A 11/1972 Argauer
3,709,979 A 1/1973 Chu
(Continued)

FOREIGN PATENT DOCUMENTS

CN 110719949 A * 1/2020 ..... B01D 3/143
EP 229295 A2 7/1987
(Continued)

OTHER PUBLICATIONS

CN110719949A English Translation (Year: 2020).*
(Continued)

*Primary Examiner* — Ellen M McAvoy
*Assistant Examiner* — Chantel Graham
(74) *Attorney, Agent, or Firm* — Shook, Hardy & Bacon L.L.P.

(57) ABSTRACT

Systems and methods are provided for expanding the operating envelope for an FCC reaction system while also reducing or minimizing the net environmental $CO_2$ emissions associated with the FCC reaction system and/or the resulting FCC products. In some aspects, reducing or minimizing net environmental $CO_2$ emissions can be achieved during processing of unconventional feeds, such as feeds that are traditionally viewed as having insufficient tendency to coke in order to maintain heat balance within an FCC reaction system. In other aspects, this can correspond to expanding the production of diesel within an FCC reaction system by modifying the reaction conditions in a manner that can cause a reaction system to fall out of heat balance
(Continued)

(relative to the heat needed to maintain a target operating temperature) even when using conventional feeds.

20 Claims, 3 Drawing Sheets

(52) U.S. Cl.
CPC ..... *C10G 2300/1074* (2013.01); *C10G 2300/202* (2013.01); *C10G 2300/4006* (2013.01); *C10G 2300/4043* (2013.01); *C10G 2300/708* (2013.01); *C10G 2400/04* (2013.01)

(58) Field of Classification Search
CPC ..... C10G 2300/202; C10G 2300/4006; C10G 2300/4043; C10G 2300/708; C10G 2400/04
See application file for complete search history.

(56) References Cited

U.S. PATENT DOCUMENTS

| | | | |
|---|---|---|---|
| 3,770,614 | A | 11/1973 | Graven |
| 3,832,449 | A | 8/1974 | Rosinski et al. |
| 3,948,758 | A | 4/1976 | Bonacci et al. |
| 4,016,245 | A | 4/1977 | Plank et al. |
| 4,076,842 | A | 2/1978 | Plank et al. |
| 4,229,424 | A | 10/1980 | Kokotailo |
| 4,254,297 | A | 3/1981 | Frenken et al. |
| 4,310,440 | A | 1/1982 | Wilson et al. |
| 4,440,871 | A | 4/1984 | Lok et al. |
| 4,500,651 | A | 2/1985 | Lok et al. |
| 4,542,114 | A | 9/1985 | Hegarty et al. |
| 8,231,777 | B2 | 7/2012 | Silva et al. |
| 8,753,502 | B1 | 6/2014 | Sexton et al. |
| 10,184,088 | B2 | 1/2019 | Marri et al. |
| 2011/0269620 | A1 | 11/2011 | Myers et al. |
| 2013/0048915 | A1 | 2/2013 | O'Connor et al. |
| 2016/0362613 | A1 | 12/2016 | Cunningham et al. |
| 2022/0363998 | A1 | 11/2022 | Diaz et al. |

FOREIGN PATENT DOCUMENTS

| | | | | |
|---|---|---|---|---|
| SG | 10201606610 | A1 * | 9/2016 | ..... B01J 19/0013 |
| WO | WO-2016200566 | A1 * | 12/2016 | ..... B01J 38/14 |

OTHER PUBLICATIONS

Güleç, F., et al., "Progress in the CO2 Capture Technologies for Fluid Catalytic Cracking (FCC) Units—A Review", Frontiers in Energy Research, vol. 8, Article 62, Frontiers Media SA, pp. 1-14 (Apr. 23, 2020).

Mello, L, F. De., et al., "A Technical and Economical Evaluation of CO2 Capture From FCC Units", Energy Procedia, vol. 1, No. 1, Elsevier BV, pp. 117-124 (Feb. 2009).

Niccum, P. K., "Diesel Creation in the FCC Centered Refinery", KBR, pp. 1-34 (May 2013).

Non-Final Office Action dated Sep. 1, 2023 in U.S. Appl. No. 18/091,095, 25 pages.

International Search Report and Written Opinion received for PCT Patent Application No. PCT/US2023/085378, mailed on Apr. 18, 2024, 13 pages.

International Search Report and Written Opinion received for PCT Patent Application No. PCT/US2023/085379, mailed on Apr. 18, 2024, 13 pages.

* cited by examiner

| | | Base | Hydrotreated Feed | Reduced Carbon Intensity Mineral Feed | Low Coke Catalyst (50% Coke) | Low Coke Catalyst Plus Hydrotreated Feed |
|---|---|---|---|---|---|---|
| | | | | | | |
| Fresh Feed Gravity | API | 19.5 | 24.2 | 46.3 | 19.5 | 24.2 |
| Total Paraffins | wt% | 16.2 | 8.3 | 49.1 | 16.2 | 8.3 |
| Total Aromatics | wt% | 58.1 | 43.2 | 21.8 | 58.1 | 43.2 |
| Relative Catalyst Coking | TFACT | 0.45 | 0.45 | 0.45 | 0.23 | 0.23 |
| | | | | | | |
| Coke Yield (w/o Torch Oil) | wt% | 6.09 | 5.43 | 4.38 | 5.36 | 4.46 |
| Hydrogen in Coke | wt% | 7.2 | 8.2 | 9.0 | 7.6 | 8.7 |
| | | | | | | |
| Torch Oil (FOEB@6.25) | BPD | 0 | 150 | 1160 | 320 | 960 |
| 6.25 MMBTU/bbl of Torch Oil | | | | | | |
| Total heat makeup required | MMBTU | | 938 | 7250 | 2000 | 6000 |
| | | | | | | |
| $CO_2$ from listed fuel (LCA Emissions) | mTon $CO_2$-eq / day | | | | | |
| Torch Oil (Base) | | 0 | 79 | 613 | 169 | 507 |
| Natural Gas | | 0 | 67 | 516 | 142 | 427 |
| Marine Pyrolysis Oil | | 0 | 10 | 79 | 22 | 65 |
| Hydrogen (Nuclear) | | 0 | 17 | 133 | 37 | 110 |
| Hydrogen (Solar) | | 0 | 9 | 70 | 19 | 58 |
| | | | | | | |
| $CO_2$ from listed fuel (Direct Emissions) | mTon $CO_2$-eq / day | | | | | |
| Natural Gas (LCA - Direct)) | | 0 | 56 | 435 | 120 | 360 |
| Natural Gas (Drygas Sheet Estimate) | | 0 | 54 | 420 | 116 | 347 |
| Drygas (Drygas Sheet Estimate) | | 0 | 59 | 454 | 125 | 375 |
| Natural Graphitic Carbon | | 0 | 111 | 857 | 236 | 709 |
| | | | | | | |

FIG. 2

| | | Base | Process for Low Coke High Temp, Low Cat Activity |
|---|---|---|---|
| | | | |
| Catalyst Activity | MAT | 69 | 45 |
| Riser Temperature | deg F | 996 | 1043 |
| Conversion, 430°F | wt% | 61.9 | 62.0 |
| Coke Yield (w/o Torch Oil) | wt% | 5.12 | 3.78 |
| Hydrogen in Coke | wt% | 7.15 | 7.73 |
| | | | |
| Torch Oil (FOEB@6.25) | BPD | 0 | 1935 |
| 6.25 MMBTU/bbl of Torch Oil | | | |
| Total heat makeup required | MMBTU | | 12094 |
| | | | |
| CO2 from listed fuel (LCA Emissions) | mTon CO2-eq / day | | |
| Torch Oil (Base) | | 0 | 1023 |
| Natural Gas | | 0 | 861 |
| Marine Pyrolysis Oil | | 0 | 131 |
| Hydrogen (Nuclear) | | 0 | 222 |
| Hydrogen (Solar) | | 0 | 117 |
| | | | |
| CO2 from listed fuel (Direct Emissions) | mTon CO2-eq / day | | |
| Natural Gas (LCA - Direct) | | 0 | 726 |
| Natural Gas (Drygas Sheet Estimate) | | 0 | 700 |
| Drygas (Drygas Sheet Estimate) | | 0 | 757 |
| Natural Graphitic Carbon | | 0 | 1429 |
| | | | |

FIG. 3

FCC PROCESSING WITH REDUCED $CO_2$ EMISSIONS

BACKGROUND

Systems and methods are provided for operating fluid catalytic cracking processes to reduce or minimize $CO_2$ emissions generated from mineral and/or conventional sources.

BACKGROUND

Fluid catalytic cracking (FCC) processes are commonly used in refineries as a method for converting feedstocks to produce lower boiling fractions suitable for use as fuels. Typical feedstocks can correspond to vacuum gas oil fractions that typically have acceptably low contaminant metal content and have an overall lower boiling range that is mostly <565° C. Such feedstocks can optionally also include lower boiling fractions already within the fuels boiling range. Vacuum resid fractions, however, are typically not as suitable for processing under FCC conditions or are blended in only as a fraction of the total feed.

Conventionally, FCC reaction systems include a reactor and an associated regenerator. During processing of the feed in the reactor, coke can accumulate on the FCC catalyst. The catalyst is periodically passed into the associated regenerator, where at least a portion of the accumulated coke is removed by combustion. The catalyst is then returned to the reactor to provide the heat for further operation of the reactor. For conventional feeds, the conditions for operating the FCC reactor can often be selected to maximize desirable products such as naphtha, distillate, fuel oil, liquid products, propylene, butylene, iso-butane, and other low and high boiling products. The operating conditions can include factors such as the reaction temperature and the catalyst to oil ratio. Such operating conditions can result in sufficient coke formation that the reactor and regenerator can be in "heat balance", so that the heat for maintaining the FCC reaction at the desired temperature is primarily derived from the heat generated in the regenerator by combustion of the coke formed on the catalyst in the reactor. It is noted that some pre-heating of the feed and/or moderation of the feed temperature can also be performed using heat exchangers and/or furnaces.

FCC reaction systems provide a refinery with a trade-off of advantages and disadvantages. A substantial advantage of FCC processing is the ability to convert higher boiling feedstocks to lower boiling fractions (and in particular fuels boiling range fractions and/or chemicals precursors like propylene and butylenes) without needing to provide hydrogen to the conversion process. However, because coke generated during the FCC process is used to provide the heat needed for maintaining the endothermic cracking process, an FCC reaction system can correspond to up to 50% of the $CO_2$ generated by a refinery.

Due to advances in catalyst and processing technology and/or improvements in understanding of reaction conditions, in some situations a feedstock may not generate sufficient coke to provide heat balance for an FCC reaction system at a desired operating temperature, and/or results in a heat balance that does not produce the quantity of one or more desirable products that could otherwise be produced if additional coke, or heat, is available. For example, heavily hydrotreated VGO feeds often have relatively low coke make under FCC conditions. As a result, processing conditions that maximize desirable products and/or liquid product yields will result in insufficient coke make to provide heat balance. In such situations, FCC reactors are typically operated to generate "discretionary coke", which is achieved by tuning the reaction conditions and/or by selecting an alternate catalyst in order to increase the coke yield (at the expense of liquid products) to achieve heat balance.

An alternative to making discretionary coke is to add a supplemental fuel to the regenerator. Conventionally, torch oil is used a supplemental fuel when an FCC unit is first started up. During start up (and optionally for some additional time after startup), torch oil can be combusted in the regenerator to provide heat until a sufficient amount of steady state coke is generated by the FCC process. Still another option for adding "additional" fuel can be to reduce the efficiency of the stripper in the FCC reactor, such as by lowering steam injection. The stripper section of an FCC reactor is used to remove hydrocarbon products that are entrained with the catalyst. When the efficiency of the stripper is reduced, an increased percentage of these hydrocarbon products are passed into the regenerator instead of being added to the total effluent. Of course, such a reduction in the efficiency of the stripper results in a corresponding decrease in total product yield.

U.S. Pat. No. 8,753,502 provides an example of an FCC reaction system that is described as being intended for use in FCC processing of severely hydrotreated feeds. In the reaction system, a separate FCC catalyst heater is used in addition to the regenerator. The separate FCC catalyst heater allows for controlled combustion of an additional fuel, to allow the reaction system to maintain heat balance when coke production in the reactor is insufficient. Examples of fuels used for combustion in the FCC catalyst heater include fuel gases, such as hydrogen-rich fuel gases.

U.S. Patent Application Publication 2016/0362613 describes addition of natural gas to a regenerator as a supplemental fuel in an FCC reaction system. This is described as allowing lighter feeds and/or heavily hydrotreated feeds to be processed under FCC conditions while avoiding the need to make discretionary coke.

U.S. Patent Application Publication 2011/0269620 provides still another example of this type of strategy, by introducing a supplemental fuel into the regenerator in a void that is proximate to an inlet for introducing unregenerated catalyst into the regenerator.

An alternative to forming discretionary coke or addition of supplemental fuel is to operate multiple FCC reactors with a common regenerator system. One FCC reactor can be used to process a feed with high coke production, while a second FCC reactor can process a feed with low coke production. The excess heat from processing of the high coke feed can then be used to maintain the heat balance for the entire system, even though a low coke feed is being processed in a separate reactor.

U.S. Pat. No. 8,231,777 describes an application of this common regenerator strategy for processing seeds from oleaginous plants in one reactor while processing a high coke feed in another reactor. U.S. Pat. No. 10,184,088 describes a variation on this strategy, where a turbulent counter-current flow reactor is paired with an FCC reactor and a common regenerator in order to maintain heat balance across the reaction system.

During operation of an FCC reaction system, while staying within the reaction envelope for maintaining heat balance, the conditions can be varied to allow for increased selectivity for a target product. For example, an article by P. Niccum of KBR, LLC. titled "Diesel Creation in the FCC Centered Refinery" describes varying the amount of feed conversion (relative to 430° F.) by varying the temperature in the FCC reactor, in order to modify the relative amounts of naphtha and distillate formed during FCC processing. The article notes that there are practical limits on increasing distillate production by reducing conversion, due to the need to maintain heat balance at an adequate regenerator temperature.

It would be desirable to have improved methods of operating an FCC process that can mitigate the $CO_2$ impact on a refinery. Additionally or alternately it would be desirable to have methods for forming FCC products while reducing or minimizing $CO_2$ production.

SUMMARY

In an aspect, a method for operating a fluid catalytic cracking reaction system is provided. The method includes exposing a hydrocarbonaceous feed to a catalyst in a reactor under fluid catalytic cracking conditions including 60 wt % or more conversion relative to 221° C. to form one or more liquid products and 6.0 wt % or less coke, the 6.0 wt % or less coke being associated with the catalyst. The method further includes passing at least a portion of the catalyst and the associated coke into a regenerator. The method further includes passing a supplemental fuel into the regenerator, a vessel associated with the regenerator, or a combination thereof, a ratio of an adjusted weight of a low carbon intensity fraction of the supplemental fuel to a weight of the associated coke being 0.01 or more. The method further includes combusting at least a portion of the associated coke and at least a portion of the supplemental fuel to form at least heated catalyst and $CO_2$. Additionally, the method includes passing at least a portion of the heated catalyst into the reactor.

Optionally, the low carbon intensity fraction can include biomass oil. Optionally, the ratio of an adjusted weight of a low carbon intensity fraction of the supplemental fuel to a weight of the associated coke can be 0.1 or more. Optionally, a ratio of an adjusted weight of the supplemental fuel to a weight of the associated coke can be 0.05 or more.

Optionally, the fluid catalytic cracking conditions can include a temperature of 525° C. or more, a catalyst to oil ratio of 2.0 to 8.0, a residence time of 5.0 seconds or less, or a combination thereof.

In another aspect, a method for operating a fluid catalytic cracking reaction system is provided. The method includes exposing a hydrocarbonaceous feed to a catalyst in a reactor under fluid catalytic cracking conditions including a temperature of 535° C. or less and 20 wt % to 65 wt % conversion relative to 221° C., to form one or more liquid products and coke associated with the catalyst. Optionally, the one or more liquid products can include 25 wt % or more of a diesel boiling range fraction relative to a weight of the hydrocarbonaceous feed. The method further includes passing at least a portion of the catalyst and the associated coke into a regenerator. The method further includes passing a supplemental fuel into the regenerator, a vessel associated with the regenerator, or a combination thereof, a ratio of an adjusted weight of a low carbon intensity fraction of the supplemental fuel to a weight of the associated coke being 0.01 or more. The method further includes combusting at least a portion of the associated coke and at least a portion of the supplemental fuel to form at least heated catalyst and $CO_2$. Additionally, the method includes passing at least a portion of the heated catalyst into the reactor.

Optionally, the one or more liquid products can include 20 wt % or more of a bottoms fraction relative to a weight of the hydrocarbonaceous feed. Optionally, the hydrocarbonaceous feed can include 15 wt % or more of a recycle portion of the bottoms fraction relative to the weight of the hydrocarbonaceous feed. Optionally, the ratio of an adjusted weight of a low carbon intensity fraction of the supplemental fuel to a weight of the associated coke can be 0.1 or more. Optionally, the ratio of an adjusted weight of the supplemental fuel to a weight of the associated coke can be 0.05 or more.

In still another aspect, a method for operating a fluid catalytic cracking reaction system is provided. The method includes exposing a hydrocarbonaceous feed to a catalyst in a reactor under fluid catalytic cracking conditions including 20 wt % or more conversion relative to 221° C. to form one or more liquid products and coke associated with the catalyst, the hydrocarbonaceous feed having a T10 distillation point of 316° C. or more, a ratio of aliphatic sulfur to total sulfur of 0.15 or more, and/or a naphthenes to aromatics ratio of 1.0 or more. The method further includes passing at least a portion of the catalyst and the associated coke into a regenerator. The method further includes passing a supplemental fuel into the regenerator, a vessel associated with the regenerator, or a combination thereof, a ratio of an adjusted weight of the supplemental fuel to a weight of the associated coke being 0.01 or more. The method further includes combusting at least a portion of the associated coke and at least a portion of the supplemental fuel to form at least heated catalyst and $CO_2$. Additionally, the method includes passing at least a portion of the heated catalyst into the reactor.

Optionally, a carbon intensity of the supplemental fuel can be equal to or less than a carbon intensity of the hydrocarbonaceous feed. Optionally, the supplemental fuel can be natural gas.

In yet another aspect, a method for operating a fluid catalytic cracking reaction system is provided. The method includes exposing a hydrocarbonaceous feed to a catalyst in a reactor under fluid catalytic cracking conditions including 20 wt % or more conversion relative to 221° C. to form one or more liquid products and coke associated with the catalyst, the hydrocarbonaceous feed including 25 wt % or less of a bio-derived fraction. The method further includes passing at least a portion of the catalyst and the associated coke into a regenerator. The method further includes passing a supplemental fuel into the regenerator, a vessel associated with the regenerator, or a combination thereof, a ratio of an adjusted weight of the supplemental fuel to a weight of the associated coke being 0.01 or more. The method further includes combusting at least a portion of the associated coke and at least a portion of the supplemental fuel to form at least heated catalyst and $CO_2$. Additionally, the method includes passing at least a portion of the heated catalyst into the reactor.

BRIEF DESCRIPTION OF THE FIGURES

FIG. 2 shows a comparison of $CO_2$ production for FCC processing at various levels of coke production.

FIG. 3 shows additional examples of FCC processing at various levels of coke production.

DETAILED DESCRIPTION

Figure 1:
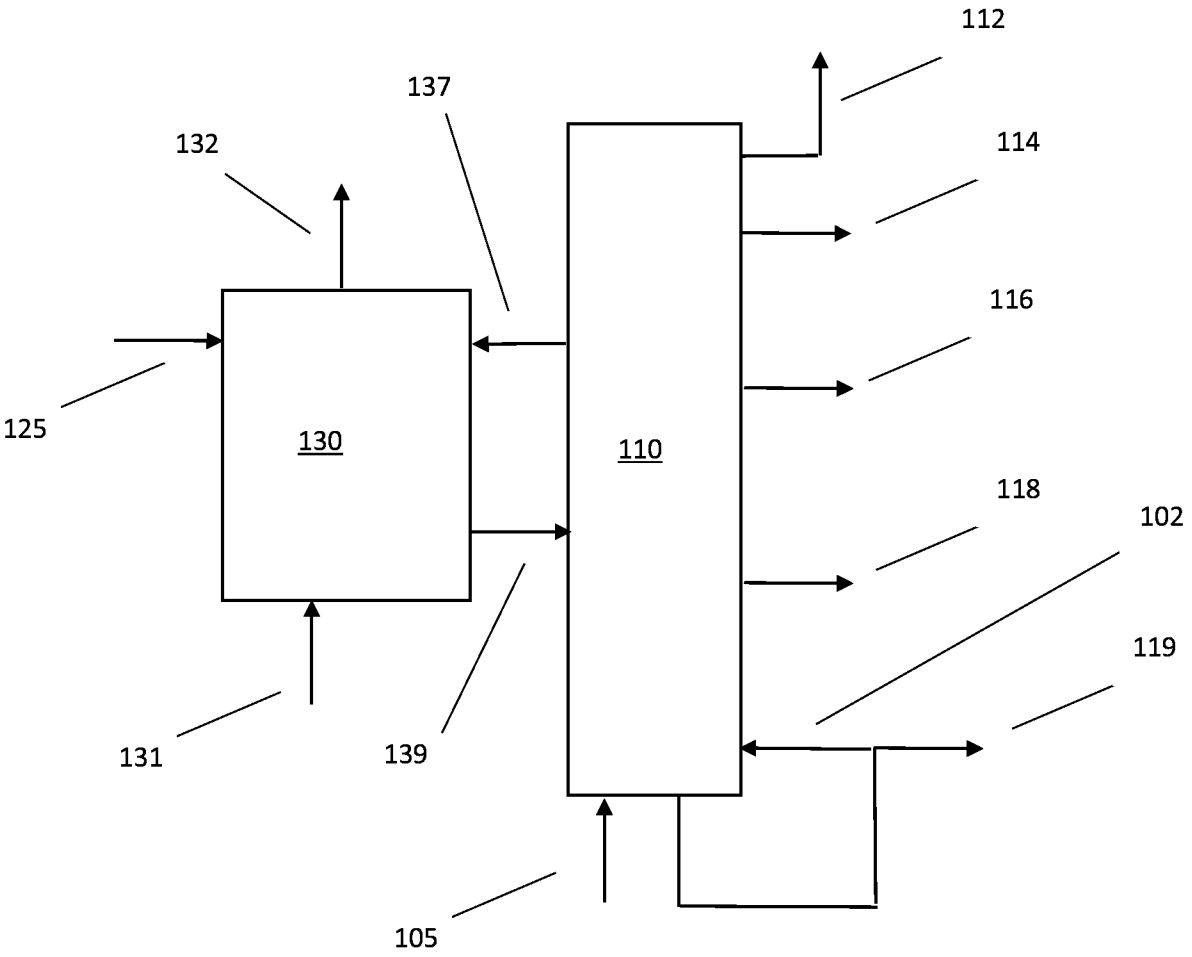
FIG. 1 shows an example of an FCC reaction system.

All numerical values within the detailed description and the claims herein are modified by "about" or "approximately" the indicated value, and take into account experimental error and variations that would be expected by a person having ordinary skill in the art.

Overview

In various aspects, systems and methods are provided for expanding the operating envelope for an FCC reaction system while also reducing or minimizing the net environmental $CO_2$ emissions associated with the FCC reaction system and/or the resulting FCC products. In some aspects, reducing or minimizing net environmental $CO_2$ emissions can be achieved during processing of unconventional feeds, such as feeds that are traditionally viewed as having insufficient tendency to coke in order to maintain heat balance within an FCC reaction system. In other aspects, this can correspond to expanding the production of diesel within an FCC reaction system by modifying the reaction conditions in a manner that can cause a reaction system to fall out of heat balance (relative to the heat needed to maintain a target operating temperature) even when using conventional feeds.

Conventionally, when bio-derived fractions of a suitable boiling range are available, conventional $CO_2$ mitigation strategies are directed to incorporating the bio-derived fractions into the feed for a process. Thus, bio-derived fractions in the distillate boiling range can be introduced as a feed to various types of hydroprocessing reactors to form, for example, renewable diesel products and/or other products containing a renewable fraction.

In various aspects, the $CO_2$ emissions associated with an FCC process and/or the resulting FCC products can be reduced or minimized by altering the nature of how low carbon intensity fractions (such as some bio-derived fractions) are used in the FCC reaction system. In particular, instead of using low carbon intensity fractions only as a feed for an FCC process, it has been discovered that substantial $CO_2$ mitigation can be achieved by using relatively small amounts of a low carbon intensity fraction as a supplemental fuel for an FCC process. Using a low carbon intensity fraction as supplemental fuel in an FCC process can leverage the amount of $CO_2$ mitigation that can be achieved from a relatively small amount of a low carbon intensity fraction. Using a low carbon intensity fraction as the supplemental fuel can allow a small amount of the low carbon intensity fraction (e.g., 5.0 wt % or less of a low carbon intensity fraction as supplemental fuel relative to a weight of the total feed input into the FCC reactor) to mitigate 15% or more of the $CO_2$ refinery emissions associated with the FCC reaction system, or 20 wt % or more, or 30 wt % or more, or 50 wt % or more, such as up to 90 wt % or possibly still higher.

In this discussion, the full $CO_2$ impact of a fuel can be quantified based on the "carbon intensity" of the fuel. The "carbon intensity" of a fuel product (e.g. diesel fuel) is defined as the life cycle GHG emissions associated with that product (g $CO_2$-eq) relative to the energy content of that fuel product (MJ, LHV basis). This definition for carbon intensity means that the carbon intensity of a fuel is not simply based on whether carbon from the fuel is directly transformed into $CO_2$ via combustion. In addition to such direct $CO_2$ emissions, carbon intensity also includes indirect $CO_2$ emissions that are associated with production and/or transport of a fuel.

In some aspects, a bio-derived fraction can be used as a low carbon intensity supplemental fuel in the regenerator of an FCC reaction system. Bio-derived fractions can potentially have a low carbon intensity because the carbon in components within a bio-derived fraction represents carbon that was previously consumed from the atmosphere. Thus, $CO_2$ produced by combustion of carbon from a bio-derived fraction does not constitute a net $CO_2$ emission, as the produced $CO_2$ is offset by a corresponding $CO_2$ that was previously consumed during biomass formation.

Using a bio-derived fraction as a supplemental fuel can provide an unexpectedly large benefit for $CO_2$ mitigation. When a bio-derived fraction is incorporated as a co-feed for an FCC reaction process, the $CO_2$ mitigation value of the bio-derived co-feed is limited based on the amount of conventional (e.g., mineral) co-feed. Thus, if only 5.0 wt % of a feed corresponds to a bio-derived fraction, only 5.0 wt % (or possibly less) of the resulting $CO_2$ from the FCC process can be attributed to the bio-derived fraction, meaning that 95 wt % (or possibly more) of the $CO_2$ from the FCC process correspond to net $CO_2$ production.

By contrast, when a feed is used in an FCC reactor that does not provide sufficient coke make to maintain heat balance relative to a target operating condition, using a bio-derived fraction as a supplemental fuel can allow the $CO_2$ mitigation benefit of the bio-derived fuel to be multiplied. In particular, during typical operation, maintaining heat balance in an FCC reactor can require combustion of roughly 5.0 wt % to 8.0 wt % of coke in the regenerator, with the weight percent of coke being based on the weight of the input feed to the reactor. Thus, the entire fuel for the regenerator corresponds to less than 10 wt % of the input feed flow. Combustion of this coke represents the substantial majority of the $CO_2$ generated by an FCC reaction system, even though the coke corresponds to only 5.0 wt % to 8.0 wt % of the feed. As a result, addition of bio-derived fuel to the regenerator can have a much larger impact on the net $CO_2$ production from the FCC reaction system, since addition of a few weight percent of a bio-derived fraction to the regenerator can represent a significantly higher fraction of the total input flows into the regenerator. It is further noted that the weight of a bio-derived fraction that is needed to generate a fixed amount of heat can be smaller than the corresponding weight of coke, thus further leveraging the amount $CO_2$ mitigation that can be achieved with a limited amount of a bio-derived fraction.

To further illustrate the unexpected leverage in benefits that can be achieved by using a bio-derived fraction as a supplemental fuel rather than a feed, consider a FCC reaction system with a conventional vacuum gas oil feedstock. In this example, a coke content on the catalyst leaving the reactor of 6.0 wt % would provide sufficient heat balance for the system. However, due to the nature of the feedstock, the processing conditions, and/or the catalyst used in the FCC reaction system, the coke production corresponds to only 4.0 wt %. If 2.0 wt % (relative to a weight of the feed) of a bio-derived fraction such as a pyrolysis oil is available, the bio-derived fraction could be used in two ways. One option would be to use the bio-derived fraction in place of 2.0 wt % of the vacuum gas oil feedstock. Regardless of how the heat balance in the reaction system is resolved, the bio-derived fraction would, at most, mitigate roughly 2.0 wt % of the $CO_2$ produced by the reaction system. By contrast, if the bio-derived fraction is used as a supplemental fuel to achieve heat balance, the bio-derived fraction would allow for mitigation of roughly 33 wt % of the $CO_2$ produced by the reaction system.

Additionally or alternately, in some aspects, unexpected benefits can be achieved for producing fuels with reduced or minimized carbon intensity by using reduced carbon intensity mineral feedstocks as part of a feed to an FCC reactor. An example of this type of feed is a vacuum gas oil boiling range feed derived from one or more Permian crude oils.

Due in part to a relatively low content of sulfur and a relatively high ratio of paraffins plus naphthenes to aromatics, crude fractions derived from Permian shale sources can be used to form fuel fractions while performing a reduced or minimized amount of processing on the fraction. For some naphtha and/or distillate fractions, this can correspond to forming a corresponding gasoline or diesel fuel with a reduced or minimized amount of hydroprocessing. Although vacuum gas oil fractions do not have an appropriate boiling range for use in a gasoline or diesel fuel, FCC processing can be used to partially convert such vacuum gas oil fractions into naphtha boiling range or distillate boiling range fractions or LPG olefins (i.e., propylene and butylenes). Such a vacuum gas oil can have a low coking tendency. By using a low carbon intensity fraction as a supplemental fuel when performing FCC processing on a reduced carbon intensity mineral feedstock, the increase in carbon intensity for fuels produced from FCC processing can be reduced or minimized. Additionally or alternately, a supplemental fuel for the regenerator can be used that has a carbon intensity that is equal to or lower than the carbon intensity of the feed to the FCC reactor, such as methane, natural gas, refinery fuel gas, or another reduced carbon intensity mineral supplemental fuel.

Still further additionally or alternately, in some aspects, unexpected benefits can be achieved by using an FCC reaction system to produce elevated yields of distillate (diesel) boiling range compounds while reducing or minimizing net $CO_2$ emissions. Conventionally, diesel production from an FCC process can be constrained due to various difficulties, including increased net coke production and/or high $CO_2$ production per unit of diesel yield due to large supplemental fuel requirements to maintain heat balance at a target operating temperature while operating at low conversion to avoid cracking distillate into lower boiling components. By using supplemental fuels in the regenerator with low net $CO_2$ emissions based on life cycle analysis, an unexpected combination can be achieved of expanding the processing envelope for distillate fuel production while still reducing or minimizing net $CO_2$ emissions.

Definitions—General

In this discussion, "biomass oil" is defined as any conversion products from a biomass conversion process that would be liquid phase at 40° C. and 100 kPa-a. It is noted that while most biomass oils are liquid phase at ambient conditions (e.g., 20° C. and 100 kPa-a), some biomass oils can set to form a wax at 20° C., and require modest amounts of heating if used in a system operated at ambient conditions. It is further noted that biomass oil has a boiling range that is broader than the boiling range for a vacuum gas oil that would typically be used as an FCC feed.

As defined herein, the term "hydrocarbonaceous" includes compositions or fractions that contain hydrocarbons and hydrocarbon-like compounds that may contain heteroatoms typically found in petroleum or renewable oil fraction and/or that may be typically introduced during conventional processing of a petroleum fraction. Heteroatoms typically found in petroleum or renewable oil fractions include, but are not limited to, sulfur, nitrogen, phosphorous, and oxygen. Other types of atoms different from carbon and hydrogen that may be present in a hydrocarbonaceous fraction or composition can include alkali metals as well as trace transition metals (such as Ni, V, Ca, or Fe).

In this discussion, unless otherwise specified, the feed to the FCC reactor refers to the hydrocarbonaceous compounds introduced into the reactor. Any diluents such as $N_2$ that may be present are considered additional components, and not considered as part of the feed. It is noted that some types of biomass oils can include a substantial water content. Unless otherwise noted, such water is not considered part of the feed.

In this discussion, conversion of a feed within an FCC reactor is defined based on the amount of feed that is converted relative to a conversion temperature. In some aspects, it can be convenient to define conversion relative to 430° F. (221° C.), which corresponds to the temperature for converting heavier components (221° C.+) to naphtha boiling range components (221° C.−). In other aspects, it can be convenient to define conversion relative to 650° F. (343° C.), which corresponds to the temperature for converting 343° C.+ components (vacuum gas oil or heavier) to 343° C.− compounds (fuels boiling range and lower). When describing reaction conditions based on conversion of a feed, the reaction conditions can be specified based on the wt % of compounds that are converted during the reaction relative to a conversion temperature, either 221° C. or 343° C. For example, specifying reaction conditions that correspond to 60 wt % conversion of a feed relative to 343° C. means that relative to the original amount of 343° C.+ compounds present in the feed, 60 wt % of those compounds are converted to products with boiling points of 343° C. or less. The remaining 40 wt % of the 343° C.+ compounds in the feed correspond to "unconverted" portions of the feed. This does not necessarily mean that the remaining 40 wt % of the feed is unreacted. It only means that the remaining 40 wt % of the 343° C.+ compounds in the feed still had boiling points above 343° C. after the reaction.

It is noted that in many aspects, the entirety of the hydrocarbonaceous feed introduced into the FCC reactor corresponds to components with a boiling point greater than 430° F. (221° C.). In such aspects, the amount of conversion can roughly be determined by subtracting the weight percentage of 430° F.+ (221° C.+) components in the liquid products from 100. It is further noted that for purposes of determining the amount of conversion, all coke produced in the reactor is defined as a conversion product. Therefore, when determining the amount of conversion relative to a conversion temperature, any coke production is added to the amount of feed converted relative to the conversion temperature.

In this discussion, unless otherwise specified, conversion is defined on a per-pass conversion basis. In this discussion, unless otherwise specified, conversion relative to a conversion temperature is defined as conversion for the total hydrocarbonaceous feed introduced into the FCC reactor. In some alternative aspects, a conversion percentage may be specified relative to a conversion temperature for conversion of only the fresh feed introduced into a reactor, excluding any recycle.

In various aspects, reference may be made to one or more types of fractions generated during distillation of a petroleum feedstock. Each of these types of fractions can be defined based on a boiling range, such as a boiling range that includes at least ~90 wt % of the fraction, or at least ~95 wt % of the fraction. For example, for naphtha fractions, at least ~90 wt % of the fraction, or at least ~95 wt %, can have a boiling point in the range of ~85° F. (~29° C.) to ~430° F. (~221° C.). For a light cycle oil (LCO) fraction or a diesel fraction, 90 wt % or more of the fraction, or 95 wt % or more, such as up to substantially of the fraction, can have a boiling point in the range of ~430° F. (~221° C.) to ~650° F. (~343° C.). For a (vacuum) gas oil fraction, 80 wt % or more of the fraction, or 90 wt % or more, or ~95 wt % or more, such as up to substantially all of the fraction, can have a boiling point in the range of ~650° F. (~343° C.) to ~1100° F. (~593° C.). It is noted that some fractions that are conventionally referred to as "vacuum gas oil" fractions may in fact correspond to a mixture of vacuum gas oil and another fraction under the definitions provided herein. Depending on how the distillation is performed, some conventional "vacuum gas oil" fractions can include up to 30 wt % of components boiling below 343° C. and/or above 593° C. In this discussion, 343° C.+ fractions used as feeds may be referred to as vacuum gas oil boiling range fractions, while an FCC product fraction of 343° C.+ compounds can be referred to as an unconverted fraction.

In this discussion, a shale crude oil is defined as a petroleum product with a final boiling point greater than 550° C., or greater than 600° C., that is extracted from a shale petroleum source. A shale oil fraction is defined as a boiling range fraction derived from a shale crude oil.

Unless otherwise specified, distillation points and boiling points can be determined according to ASTM D2887. For samples that are not susceptible to characterization using ASTM D2887, D7169 can be used. It is noted that still other methods of boiling point characterization may be provided in the examples. The values generated by such other methods are believed to be indicative of the values that would be obtained under ASTM D2887 and/or D7169.

In some aspects, a fraction (such as a shale oil fraction or a bio-derived fraction) can correspond to a fraction that has not been hydroprocessed and/or that has not been cracked. In this discussion, a non-hydroprocessed fraction is defined as a fraction that has not been exposed to more than 10 psia of $H_2$ in the presence of a catalyst comprising a Group VI metal, a Group VIII metal, a catalyst comprising a zeolitic framework, or a combination thereof. In this discussion, a non-cracked fraction is defined as a fraction that has not been exposed to a temperature of 400° C. or more.

In this discussion, a hydroprocessed fraction is defined as a hydrocarbon fraction and/or hydrocarbonaceous fraction that has been exposed to a catalyst having hydroprocessing activity in the presence of 300 kPa-a or more of $H_2$ at a temperature of 200° C. or more. A hydroprocessed fraction can be hydroprocessed prior to separation of the fraction from a crude oil or another wider boiling range fraction.

In this discussion, a carbon-containing fuel is defined as a fuel where combustion of the fuel results in formation of $CO_2$. Methane is an example of a carbon-containing fuel, as combustion of methane results in formation of $CO_2$ and $H_2O$. By contrast, combustion of $H_2$ results only in formation of $H_2O$.

In this discussion, the lower heating value of a fuel has the conventional definition of the theoretical total quantity of heat liberated by combustion of a fuel to form fully oxidized products (e.g., $CO_2$ and $H_2O$) at 25° C. and 101 kPa-a, with all generated water remaining in the vapor phase.

Definitions—Life Cycle Assessment and Carbon Intensity

Life cycle assessment (LCA) is a method of quantifying the "comprehensive" environmental impacts of manufactured products, including fuel products, from "cradle to grave". Environmental impacts may include greenhouse gas (GHG) emissions, freshwater impacts, or other impacts on the environment associated with the finished product. The general guidelines for LCA are specified in ISO 14040.

The "carbon intensity" of a fuel product (e.g. gasoline or diesel fuel) is defined as the life cycle GHG emissions associated with that product (g $CO_2$-eq) relative to the energy content of that fuel product (MJ, LHV basis). Life cycle GHG emissions associated with petroleum-derived fuel products must include GHG emissions associated with crude oil production; crude oil transportation to a refinery; refining of the crude oil; transportation of the refined product to point of "fill"; and combustion of the fuel product. More generally, life cycle GHG emissions for fuel products can include GHG emissions associated with raw material extraction; raw material transportation; processing; fuel transportation; dispensing (if any); and use/combustion.

In this discussion, a "low carbon intensity" fuel, feedstock, and/or fraction is defined as a fuel, feedstock, and/or fraction with life cycle assessment (LCA) $CO_2$ emissions of less than 40 metric tons of $CO_2$-eq per 100 MMBTU. It is noted that the direct $CO_2$ emissions for combustion of a mineral hydrocarbonaceous fuel, feedstock, and/or fraction are generally greater than 50 metric tons of $CO_2$ per 100 MMBTU, independent of any other contributions from extraction, transport, and/or refining of such a fuel, feedstock, and/or fraction.

In this discussion, a "reduced carbon intensity mineral" fuel, feedstock, and/or fraction is defined as a fuel, feedstock, and/or fraction that has direct $CO_2$ emissions of greater than 50 metric tons of $CO_2$ per 100 MMBTU, but that is substantially composed of fractions that have been exposed to reduced or minimized amounts of processing. Natural gas fractions are an example of a reduced carbon intensity mineral fraction. Another example is a fraction derived from a crude oil such as a Permian shale oil, where the fraction can be used for various purposes with a reduced or minimized amount of additional processing.

GHG emissions associated with the stages of refined product life cycles are assessed as follows.

(1) GHG emissions associated with drilling and well completion—including hydraulic fracturing, shall be normalized with respect to the expected ultimate recovery of sales-quality crude oil from the well.

(2) All GHG emissions associated with the production of oil and associated gas, including those associated with (a) operation of artificial lift devices, (b) separation of oil, gas, and water, (c) crude oil stabilization and/or upgrading, among other GHG emissions sources shall be normalized with respect to the volume of oil transferred to sales (e.g. to crude oil pipelines or rail). The fractions of GHG emissions associated with production equipment to be allocated to crude oil, natural gas, and other hydrocarbon products (e.g. natural gas liquids) shall be specified accordance with ISO 14040.

(3) GHG emissions associated with rail, pipeline or other forms of transportation between the production site(s) to the refinery shall be normalized with respect to the volume of crude oil transferred to the refinery.

(4) GHG emissions associated with the refining of crude oil to make liquefied petroleum gas, gasoline, distillate fuels and other products shall be assessed, explicitly accounting for the material flows within the refinery. These emissions shall be normalized with respect to the volume of crude oil refined.

(5) All of the preceding GHG emissions shall be summed to obtain the "Well to refinery" (WTR) GHG intensity of crude oil (e.g. kg $CO_2$-eq/bbl crude).

(6) For each refined product, the WTR GHG emissions shall be divided by the product yield (barrels of refined product/barrels of crude), and then multiplied by the share of refinery GHG specific to that refined product. The allocation procedure shall be conducted in accordance with ISO 14040. This procedure yields the WTR GHG intensity of each refined product (e.g. kg $CO_2$-eq/bbl gasoline).

(7) GHG emissions associated with rail, pipeline or other forms of transportation between the refinery and point of fueling shall be normalized with respect to the volume of each refined product sold. The sum of the GHG emissions associated with this step and the previous step of this procedure is denoted the "Well to tank" (WTT) GHG intensity of the refined product.

(8) GHG emissions associated with the combustion of refined products shall be assessed and normalized with respect to the volume of each refined product sold.

(9) The "carbon intensity" of each refined product is the sum of the combustion emissions (kg $CO_2$-eq/bbl) and the "WTT" emissions (kg $CO_2$-eq/bbl) relative to the energy value of the refined product during combustion. This corresponds to the "well to wheel" value. Following the convention of the EPA Renewable Fuel Standard 2, these emissions are expressed in terms of the low heating value (LHV) of the fuel, i.e. g $CO_2$-eq/MJ refined product (LHV basis).

It is noted that bio-derived fractions can be formed to have substantially lower carbon intensities than other carbon-containing fuels. This is due in part to the fact that $CO_2$ generated from bio-derived fuels is offset by the $CO_2$ that was consumed during growth of the underlying biomass. The carbon intensity of a bio-derived fuel can be further offset by using biomass (or another bio-derived fuel) as the heat source for converting the biomass into a fuel. Thus, it is possible for fuels based on bio-derived fractions to have a carbon intensity that approaches zero. It is further noted that if a carbon capture and sequestration process is associated with a biofuel production process, the carbon intensity for a fuel based on a bio-derived fraction could even correspond to a negative value.

Feedstocks for FCC Reactor

A variety of types of feedstocks can be incorporated into the feed to an FCC reactor. Some feedstocks can correspond to conventional feedstocks. Other feedstocks can correspond to bio-derived fractions. Still other feedstocks can correspond to low carbon intensity feedstocks. Yet other feedstocks can correspond to reduced carbon intensity mineral feedstocks. Still other feedstocks can correspond to conventional feedstocks that have a reduced or minimized tendency to form coke under FCC processing conditions. In some aspects, a feed can substantially correspond to one type of feedstock. Examples include feeds containing 95 wt % or more of one or more bio-derived fractions, or 95 wt % or more of one or more low carbon intensity feedstocks, or 95 wt % or more of one or more reduced carbon intensity mineral feedstocks, or 95 wt % or more of one or more conventional feedstocks that have a reduced or minimized tendency to form coke under FCC processing conditions, or 95 wt % or more of one or more conventional feedstocks. Such feeds can potentially include up to 100 wt % of the corresponding feedstock.

In other aspects, a feed can correspond to a blend or mixture two or more types of feedstocks. In some aspects, a feed can include 5.0 wt % to 95 wt % of bio-derived fraction, or 5.0 wt % to 50 wt %, or 5.0 wt % to 35 wt %, or 5.0 wt % to 20 wt %, or 20 wt % to 95 wt %, or 20 wt % to 50 wt %, or 35 wt % to 95 wt %, or 50 wt % to 95 wt %. Additionally or alternately, in some aspects, a feed can include 5.0 wt % to 95 wt % of low carbon intensity feedstock and/or a reduced carbon intensity mineral feedstock, or 5.0 wt % to 50 wt %, or 5.0 wt % to 35 wt %, or 5.0 wt % to 20 wt %, or 20 wt % to 95 wt %, or 20 wt % to 50 wt %, or 35 wt % to 95 wt %, or 50 wt % to 95 wt %. Further additionally or alternately, in some aspects, a feed can include 5.0 wt % to 95 wt % of a conventional feedstock and/or a conventional feedstock having a reduced or minimized tendency to form coke under FCC processing conditions, or 5.0 wt % to 50 wt %, or 5.0 wt % to 35 wt %, or 5.0 wt % to 20 wt %, or 20 wt % to 95 wt %, or 20 wt % to 50 wt %, or 35 wt % to 95 wt %, or 50 wt % to 95 wt %. It is noted that a feed can also potentially include less than 5.0 wt % of any of the above types of feedstocks.

In some aspects, at least a portion of the feed to an FCC reactor can correspond to a reduced carbon intensity mineral feedstock. In this discussion, a reduced carbon intensity mineral feedstock, fuel, or fraction corresponds to a feedstock, fuel, or fraction that has reduced GHG emissions per unit of lower of heating value relative to a feedstock, fuel, or fraction derived from a conventional petroleum source. In some aspects, the reduced GHG emissions can be due in part to reduced refinery processing. For example, fractions that are not hydroprocessed for sulfur removal have reduced well-to-refinery emissions relative to fractions that require hydroprocessing prior to incorporation into a fuel.

Some reduced carbon intensity mineral feedstocks, fuels, and/or fractions can include certain types of shale oil fractions, such as shale oil fractions with an unexpectedly high weight ratio of naphthenes to aromatics while also having a low but substantial content of aromatics. Shale oil fractions derived from Permian crude oils are examples of this type of mineral low carbon intensity feedstock. As examples of properties, a vacuum gas oil fraction derived from some Permian crudes can have an initial boiling point of 371° C. and a final boiling point of 538° C. and/or a T10 distillation point of 385° C. to 395° C. and a T90 distillation point of 480° C. to 490° C. Such a vacuum gas oil fraction can have an unexpectedly high ratio of naphthenes (cycloparaffins) to aromatics of 1.0 or more, or 1.5 or more, or 2.0 or more, such as up to 6.0 or possibly still higher, while also including 8.0 wt % to 32 wt % aromatics, or 8.0 wt % to 22 wt %, or 10 wt % to 32 wt %, or 10 wt % to 22 wt %. The vacuum gas oil fraction can further have an unexpected combination of a low density at 15° C. of 860 kg/$m^3$ to 892 kg/$m^3$ (or 860 kg/$m^3$ to 882 kg/$m^3$); an energy content of 42.4 MJ/kg or greater; a low kinematic viscosity at 50° C. of 20 cSt to 30 cSt; a low sulfur content of 0.03 wt % to 0.20 wt %; a low nitrogen content of 1000 wppm or less, or 850 wppm or less, or 350 wppm or less, such as down to 30 wppm; a CCAI value of 760 to 785; a molar ratio of hydrogen to carbon of greater than 1.8; and an acid number of less than 0.15 mg KOH/kg, or less than 0.12 mg KOH/kg.

Another indicator of a reduced carbon intensity mineral feedstock, fuel, or fraction can be an elevated ratio of aliphatic sulfur to total sulfur in a fuel or fuel blending product. Aliphatic sulfur is generally easier to remove than other types of sulfur present in a hydrocarbon fraction. In a hydrotreated fraction, the aliphatic sulfur will typically be removed almost entirely, while other types of sulfur species will remain. The presence of increased aliphatic sulfur in a product can indicate a lack of hydroprocessing for the product. In various aspects, a ratio of the aliphatic sulfur content to total sulfur content for a reduced carbon intensity mineral feedstock can be 0.2 or more, or 0.3 or more, such as up to 0.8 or possibly still higher.

Still another indicator of a reduced carbon intensity mineral feedstock, fuel, or fraction can be an elevated ratio of basic nitrogen to total nitrogen in a fuel or fuel blending product. Basic nitrogen is typically easier to remove by hydrotreatment. The presence of an increased amount of basic nitrogen in a product can therefore indicate a lack of hydroprocessing for the product.

Yet other ways of reducing carbon intensity for a hydrocarbon fraction can be related to methods used for extraction of a crude oil. For example, carbon intensity for a fraction can be reduced by using solar power, hydroelectric power, or another renewable energy source as the power source for equipment involved in the extraction process, either during drilling and well completion and/or during production of crude oil. As another example, extracting crude oil from an extraction site without using artificial lift can reduce the carbon intensity associated with a fuel.

Additionally or alternately, in some aspects at least a portion of the feed to an FCC reactor can correspond to a bio-derived fraction. Bio-derived fractions are derived from biomass, and therefore the carbon in a bio-derived fraction can correspond to carbon that was originally extracted from the air during growth of the biomass. As a result, any $CO_2$ generated from the biomass is offset by the $CO_2$ that was consumed during biomass growth.

For use as a feed to an FCC reaction system, in some aspects a bio-derived fraction can correspond to a biomass oil. Biomass oils can be formed in various ways. Some biomass oils can correspond to pyrolysis oils, such as $C_{5+}$ fractions formed by fast pyrolysis, hydrothermal liquefaction, catalytic pyrolysis, or another convenient conversion process that results in formation of at least light gases, biomass oil, and optionally a char or coke product.

In some aspects, another option can be to use a portion of a pyrolysis oil as a biomass oil. One of the difficulties with using pyrolysis oil as a feed for formation of commercial fuels is that the higher boiling portions (or higher boiling fraction) can be more difficult to process. For example, the lighter (lower boiling) portions of a pyrolysis oil can be readily upgraded using conventional hydroprocessing methods to form hydroprocessing pyrolysis oil fraction that can incorporated as part of a feed for conventional production of motor fuels, heating fuels, and/or other applications. However, the heavier (higher boiling) portions of some pyrolysis oils can require higher severity conditions. Additionally or alternately, such heavier portions can undergo lower amounts of conversion when exposed to hydroprocessing conditions, thus requiring product recycle in order to upgrade a pyrolysis oil for incorporation as part of a feed for fuels production.

In some aspects, during and/or after generation of a pyrolysis oil, a pyrolysis oil can be split into two or more fractions, such as a lighter fraction and a heavier fraction. In such aspects, one or more lighter (lower boiling) fractions can be used as part of a feed for formation of commercial fuels. Optionally, the lighter portion(s) could be included as part of the feed to the FCC reactor. One or more heavier (higher boiling) portions of the pyrolysis oil can then be used as a supplemental fuel. This can reduce, minimize, or eliminate the need to upgrade the heavier portion of the pyrolysis oil while also obtaining the benefits of using a low carbon intensity fraction as a supplemental fuel. As an example, a separation can be performed on a pyrolysis oil to form a heavy pyrolysis oil fraction and a second pyrolysis oil fraction having a lower boiling range. One option for illustrating such a lower boiling range is that the heavy pyrolysis oil fraction can have a T50 distillation temperature that is higher than a T90 distillation temperature for the lower boiling fraction. In other words, at least half of the heavy pyrolysis oil fraction has a boiling point greater than the T90 distillation point for the second (lower boiling) fraction.

Other biomass oils can correspond to residual fractions generated during biomass processing, such as oils generated as a by-product during biomass fermentation. Corn oil formed during conversion of corn biomass into ethanol is an example of an additional or residual oil formed during biomass processing. In still other aspects, a bio-derived fraction can more generally correspond to a fraction that is a liquid at 20° C. and 100 kPa-a. General examples of bio-derived fractions can include, but are not limited to, fatty acid alkyl esters (such as fatty acid methyl esters), triglycerides, and free fatty acids.

Biomass oil can generally correspond to $C_{5+}$ hydrocarbonaceous compounds that are formed during the biomass conversion process, although other compounds could be present if they are liquid at 20° C. and 100 kPa-a. The oxygen content of the biomass oil can vary depending on the nature of the conversion process used to form the biomass. In some aspects, the oxygen content of the biomass oil can be between 2.0 wt % to 60 wt %, or 2.0 wt % to 50 wt %, or 5.0 wt % to 60 wt %, or 5.0 wt % to 50 wt %, or 10 wt % to 60 wt %, or 10 wt % to 50 wt %. It is noted that the range of oxygen contents may be somewhat lower for biomass oil formed by certain methods, such as hydrothermal liquefaction. In some aspects, the biomass oil can have an oxygen content of 5.0 wt % to 20 wt %, or 5.0 wt. % to 15 wt. %.

Still yet another option can be to use any convenient type of biomass that can be delivered into the FCC reactor and/or into the regenerator as a supplemental fuel. This can potentially include vegetable oils, animal fats, waste biomass streams (e.g., corn oil generated during fermentation of corn biomass), and/or other convenient biomass streams.

More generally, a wide range of petroleum and chemical feedstocks can be incorporated into a feed for an FCC reactor. Suitable feedstocks include whole and reduced petroleum crudes, atmospheric, cycle oils, gas oils, including vacuum gas oils and coker gas oils, light to heavy distillates including raw virgin distillates, hydrocrackates, hydrotreated oils, extracts, slack waxes, Fischer-Tropsch waxes, raffinates, and mixtures of these materials. Additionally or alternately, an FCC input feed can include, for example, feeds with an initial boiling point and/or a T5 boiling point and/or T10 boiling point of at least 430° F. (221° C.), or at least ~600° F. (~316° C.), or at least ~650° F. (~343° C.), or at least ~700° F. (371° C.), or at least ~750° F. (~399° C.). Additionally or alternately, the final boiling point and/or T95 boiling point and/or T90 boiling point of the feed can be ~1100° F. (~593° C.) or less, or ~1050° F. (~566° C.) or less, or ~1000° F. (~538° C.) or less, or ~950° F. (~510° C.) or less. In particular, a feed can have a T5 to T95 boiling range of ~316° C. to ~593° C., or a T5 to T95 boiling range of ~343° C. to ~566° C., or a T10 to T90 boiling range of ~343° C. to ~566° C. Such fractions generally correspond to vacuum gas oil fractions, with some inclusion of lower and/or higher boiling components. Optionally, it can be possible to use a feed that includes a lower boiling range portion. Such a feed can have an initial boiling point and/or a T5 boiling point and/or T10 boiling point of at least ~350° F. (~177° C.), or at least ~400° F. (~204° C.), or at least 430° F. (221° C.), or at least ~450° F. (~232° C.). In particular, such a feed can have a T5 to T95 boiling range of ~177° C. to ~593° C., or a T5 to T95 boiling range of ~221° C. to ~593° C., or a T10 to T90 boiling range of ~ 177° C. to ~566° C., or a T10 to T90 boiling range of 221° C. to 566° C. Still another option for characterizing a fraction for use as a feed for an FCC reactor can be based on a T50 distillation point. In some aspects, a feed can have a T50 distillation point of 343° C. or higher, or 371° C. or higher, or 400° C. or higher, such as up to 525° C. or possibly still higher. Optionally, it is noted that for feeds with substantially increased amounts of paraffins and/or saturates, it may be possible to include additional feed components with a boiling range greater than 593° C.).

In some aspects, the feed and/or a feedstock corresponding to at least a portion of the feed can have a sulfur content of ~500 wppm to ~50000 wppm or more, or ~500 wppm to ~20000 wppm, or ~500 wppm to ~10000 wppm. Additionally or alternately, the nitrogen content of such a feed can be ~20 wppm to ~8000 wppm, or ~50 wppm to ~4000 wppm. In some aspects, the feed can correspond to a "sweet" feed, so that the sulfur content of the feed can be ~ 10 wppm to ~500 wppm and/or the nitrogen content can be ~1 wppm to ~ 100 wppm. In still other aspects, a feed can be substantially free from sulfur, such as a feed that is substantially composed of bio-derived fractions and/or heavily hydroprocessed fractions.

Optionally, prior to FCC processing, a feedstock can be hydrotreated. An example of a suitable type of hydrotreatment can be hydrotreatment under trickle bed conditions. Hydrotreatment can be used, optionally in conjunction with other hydroprocessing, to form an input feed for FCC processing based on an initial feed. Hydroprocessing can, for example, reduce the sulfur content and nitrogen content of a feedstock. The sulfur and/or nitrogen contents described herein can correspond to sulfur contents and/or nitrogen contents either prior to hydroprocessing or after hydroprocessing.

In optional aspects where hydroprocessing is performed on at least a portion of the feed, hydroprocessing (such as hydrotreating) can be carried out in the presence of hydrogen ($H_2$). A hydrogen stream can be fed or injected into a vessel or reaction zone or hydroprocessing zone corresponding to the location of a hydroprocessing catalyst. Hydrogen, contained in a hydrogen "treat gas," can be provided to the reaction zone. Treat gas, as referred to herein, can be either pure $H_2$ or a hydrogen-containing gas stream containing $H_2$ in an amount that is selected based on the intended reaction(s). Treat gas can optionally include one or more other gasses (e.g., nitrogen and light hydrocarbons such as methane) that do not adversely interfere with or affect either the reactions or the products. Impurities, such as $H_2S$ and $NH_3$ are undesirable and can typically be removed from the treat gas before conducting the treat gas to the reactor. In aspects where the treat gas stream can differ from a stream that substantially consists of hydrogen (i.e., at least 99 vol % $H_2$), the treat gas stream introduced into a reaction stage can contain at least 50 vol % $H_2$, or at least 75 vol % $H_2$, or at least 90 vol % $H_2$.

During hydrotreatment, a feedstock can be contacted with a hydrotreating catalyst under effective hydrotreating conditions which include temperatures in the range of 450° F. to 800° F. (~232° C. to ~427° C.), or 550° F. to 750° F. (~288° C. to ~399° C.); pressures in the range of 1.5 MPag to 20.8 MPag (~200 to ~3000 psig), or 2.9 MPag to 13.9 MPag (~400 to ~2000 psig); a liquid hourly space velocity (LHSV) of from 0.1 to 10 $hr^{-1}$, or 0.1 to 5 $hr^{-1}$; and a hydrogen treat gas rate of from 430 to 2600 $Nm^3/m^3$ (~2500 to ~15000 SCF/bbl), or 850 to 1700 $Nm^3/m^3$ (~5000 to ~10000 SCF/bbl).

Hydrotreating catalysts suitable for use herein can include those containing at least one Group VIA metal and at least one Group VIII metal, including mixtures thereof. Examples of suitable metals include Ni, W, Mo, Co and mixtures thereof, for example CoMo, NiMoW, NiMo, or NiW. These metals or mixtures of metals are typically present as oxides or sulfides on refractory metal oxide supports. The amount of metals for supported hydrotreating catalysts, either individually or in mixtures, can range from ~0.5 to ~35 wt %, based on the weight of the catalyst. Additionally or alternately, for mixtures of Group VIA and Group VIII metals, the Group VIII metals can be present in amounts of from ~0.5 to ~5 wt % based on catalyst, and the Group VIA metals can be present in amounts of from 5 to 30 wt % based on the catalyst. A mixture of metals may also be present as a bulk metal catalyst wherein the amount of metal can comprise ~30 wt % or greater, based on catalyst weight. Suitable metal oxide supports for the hydrotreating catalysts include oxides such as silica, alumina, silica-alumina, titania, or zirconia. Examples of aluminas suitable for use as a support can include porous aluminas such as gamma or eta.

Supplemental Fuels

In various aspects, the combination of the feed delivered to the FCC reactor and the conditions for operating the FCC reactor can cause the coke produced in the FCC reactor to be insufficient to provide heat balance for the FCC reaction system during combustion in the regenerator. In such aspects, at least a portion of the heat provided to the FCC reactor from the FCC regenerator can correspond to heat provided by combustion of a supplemental fuel.

The amount of coke production required to maintain heat balance in an FCC reaction system can vary depending on the specific configuration. However, the amount of coke in the FCC regenerator that is needed for heat balance can generally correspond to 3.0 wt % to 6.5 wt % coke, relative to the weight of the feed introduced into the FCC reactor. Under this definition, the "coke" corresponds to any coke on the FCC catalyst plus any other trapped/entrained compounds that are carried with the FCC catalyst from the reactor to the regenerator. With regard to determining the amount of coke on a catalyst sample, commercially available units are available for performing this determination. In this discussion, coke contents on catalyst samples were determined using a LECO SC 632 carbon, sulfur analyzer. This commercially available unit measures coke on a catalyst sample by performing combustion on the coke and measuring the resulting amount of $CO_2$ that is generated. It is believed that comparable values could be determined using other combustion-based carbon, sulfur analyzers available from LECO Corporation of St. Joseph, MI.

In various aspects, the amount of coke passed into the FCC regenerator from the FCC reactor can correspond to 10.0 wt % or less of coke relative to the weight of the feed to the FCC reactor, or 8.0 wt % or less, or 6.0 wt % or less, or 5.5 wt % or less, or 5.0 wt % or less, or 4.5 wt % or less, or 4.0 wt % or less, or 3.5 wt % or less, such as down to 1.0 wt % or possibly still lower. This coke amount is relative to the total hydrocarbonaceous feed amount introduced into the FCC reactor, including any recycled fractions (such as a recycled FCC bottoms or catalytic slurry oil fraction).

It is noted that some coke may remain on the catalyst after passing through the regenerator, even though the regenerator conditions are selected to perform substantially complete combustion. Thus, the heat generated in the regenerator corresponds to heat generated from the difference between coke entering the regenerator and coke exiting from the regenerator. This amount of coke is sometimes referred to as "delta coke". In this discussion, complete combustion of all coke on a catalyst is defined as reducing the average weight of coke on catalyst to 0.05 wt % or less, relative to the weight of the catalyst. In some aspects, the amount of coke remaining on the catalyst after combustion can be 0.5 wt % or less, or 0.3 wt % or less, or 0.2 wt % or less, down to having substantially complete combustion of all coke.

When the coke make from a feed is not sufficient to maintain heat balance at a target set of conditions, a supplemental fuel can be added to the FCC regenerator. Conventionally, there is substantially no benefit to adding a supplemental fuel to the regenerator unless the FCC reaction system cannot maintain heat balance at a desired or target operating temperature (and/or at other target operating conditions). Various types of supplemental fuels can be used for the FCC regenerator. In some aspects, the supplemental fuel can correspond to a bio-derived fraction, such as biomass oil, pyrolysis oil, vegetable oil, waste biomass streams, and/or another convenient type of bio-derived fraction. Additionally or alternately, in some aspects the supplemental fuel can correspond to a carbon-containing fuel. Optionally, at least a portion of the carbon-containing supplemental fuel can correspond to such a bio-derived fraction. In some optional aspects, a supplemental fuel can consist essentially of carbon-containing fuel, so that the lower heating value of any $H_2$ in the supplemental fuel corresponds to less than 5.0% of the total lower heating value of the supplemental fuel.

Optionally, in some aspects a minor portion of the supplemental fuel can correspond to hydrogen ($H_2$). In such aspects, one option can be to use $H_2$ produced via a method so that the $H_2$ corresponds to a low carbon intensity fuel. Some examples of such methods include $H_2$ produced by electrolysis with electricity generated via nuclear power, hydroelectric power, wind power, or solar power. Such $H_2$ is sometimes referred to as "green hydrogen". Another low intensity method for $H_2$ production can be to form $H_2$ via reforming (such as steam methane reforming), and then capture/sequester the $CO_2$ produced during reforming. Such $H_2$ is sometimes referred to as "blue hydrogen". Other types of hydrogen can have carbon intensities that are higher than the definition for a low carbon intensity fuel. For example, $H_2$ formed by steam methane reforming without an associated carbon capture process can have a carbon intensity greater than 40 metric tons of $CO_2$-eq per 100 MMBTU.

It is noted that the amount of hydrogen ($H_2$) that can be incorporated into a supplemental fuel is limited. Due in part to the high flame speed of $H_2$, a supplemental fuel where 30% or more of the lower heating value of the fluid phase of the supplemental fuel is provided by $H_2$ cannot be readily introduced into an FCC regenerator environment and/or a secondary regenerator vessel without somehow accounting for the difference in combustion properties between $H_2$ and hydrocarbon fuels. Due to these difficulties, supplemental fuels are defined herein to correspond to fuels where less than 30% of the lower heating value of the fluid phase of the supplemental fuel is provided by $H_2$. As an example of the difficulties with attempting to use a high $H_2$ content fuel as a supplemental fuel, it is noted that the combustion of supplemental fuel in a regenerator (and/or in a secondary regenerator vessel) is used to increase the temperature of the FCC catalyst particles and/or other heat transfer particles in the regenerator. The heated particles are then returned to the reactor to provide heat for the cracking reaction. If the nature of the combustion of the supplemental fuel results in the supplemental fuel being combusted in a region that is separate from the catalyst (and/or other particles), the transfer of heat to the particles can be substantially reduced, thus reducing the heat that is subsequently transferred into the cracking reactor. The high flame speed of $H_2$ (and/or other $H_2$ combustion properties such as low molecular weight and density) can make it difficult to combust a high $H_2$ content fuel in a target location for heating catalyst/heat transfer particles. In addition to reducing the efficiency of heating, such difficulties in controlling the location for combustion can lead to high temperature spikes in unexpected locations within a reaction system, which could pose safety concerns. It is noted that in a fuel stream containing only $H_2$ and $CH_4$, a composition of 60 mol % $H_2$ and 40 mol % $CH_4$ would result in the lower heating value of the $H_2$ corresponding to roughly 30% of the total heating value of the fuel stream.

In some alternative aspects, still another option can be to use a reduced carbon intensity mineral fuel as a supplemental fuel. For example, methane has a relatively high heat of combustion per $CO_2$ molecule generated during combustion. Thus, due to the relatively low direct $CO_2$ production in comparison with other types of mineral fuels (such as typical torch oils). In some alternative aspects, natural gas and other high methane content fractions can potentially be used as a supplemental fuel that corresponds to a reduced carbon intensity mineral supplemental fuel. Another potential low carbon intensity mineral fuel is refinery dry gas. Refinery dry gas corresponds to a possibly dilute mixture of carbon-containing fuels that include a high weight percentage of hydrogen atoms, such as methane, ethane, propane, butane, and possibly some pentane, hexane and other low molecular weight hydrocarbons. Such dry gas is generated, for example, by FCC units as well as some other refinery units. Due to the potential for high levels of diluent content (such as $N_2$), refinery dry gas often has a relatively low value within a refinery. However, due to the relatively high heat of combustion per $CO_2$ molecule generated, refinery dry gas can also potentially serve as a reduced carbon intensity mineral supplemental fuel.

Supplemental fuel can be added to the regenerator in any convenient manner. One option can be to introduce supplemental fuel in the same manner that a torch oil would be introduced during the start-up phase for the FCC reaction system. Another option can be to have dedicated conduits for introducing the supplemental fuel into the regenerator. Still another option can be to introduce the supplemental fuel into a pre-combustion chamber, catalyst heater, or another type of secondary regeneration vessel associated with the regenerator. Still another option can be to add the supplemental fuel to the FCC stripper and/or a transfer line between the FCC reactor and the FCC regenerator. It is noted that such a secondary regeneration vessel may correspond to the actual location of combustion for the supplemental fuel. Introducing a supplemental fuel into either a primary regenerator vessel or a secondary regenerator vessel is included within the definition of introducing a supplemental fuel into the regenerator herein. It is noted that the combustion conditions in a secondary regenerator vessel can be the same as the combustion conditions in the primary regenerator vessel, or the combustion conditions in the secondary regenerator vessel can be different. In the event that the supplemental fuel is at least partially in the form of solid biomass particles, various types of feeders are available for introducing the supplemental fuel into the regenerator and/or secondary regeneration vessel, such as screw feeders.

In some aspects where at least a portion of the supplemental fuel corresponds to a pyrolysis oil (and/or optionally another type of biomass oil), the pyrolysis oil can be introduced into a regenerator or other vessel along with a fluid stream for atomizing or distributing the pyrolysis oil. In such aspects, the fluid stream for atomizing or otherwise assisting with distributing the pyrolysis oil (and/or optionally biomass oil) can correspond to a fluid stream at a temperature of between 20° C. and 80° C. Conventionally, steam is a commonly used atomization stream for distributing a fuel into a combustion zone. However, due to the lower temperature for the atomization stream in this type of aspect, the fluid for atomization can correspond to $N_2$ and/or other lower temperature gases that are compatible with the regeneration environment. Without being bound by any particular theory, it is believed that using a fluid stream at a temperature between 20° C. and 80° C. for atomization of pyrolysis oil can reduce or minimize the potential for decomposition of the pyrolysis oil while also reducing or minimizing changes in fluid flow properties due to increased viscosity at lower temperatures.

In various aspects, the amount of supplemental fuel combusted in the regenerator can be characterized relative to the amount of coke combusted in the regenerator. One option for making such a comparison would be to compare lower heating values for the coke and lower heating values for the supplemental fuel, relative to the weight of each in the regenerator. While this could be done, this would require detailed calculations based on the exact composition of the coke, including the sulfur, nitrogen, and hydrogen contents of the coke. It is noted that any hydrocarbons or other components that are not stripped from an FCC catalyst prior to entering the regenerator are considered as part of the coke under this definition. Additional detailed calculations based on the composition of the supplemental fuel would also be needed.

In order to avoid the need for detailed calculations to determine exact lower heating values for the coke (including trapped hydrocarbons), in this discussion the relative amounts of supplemental fuel and coke are compared based on a weight of coke in the regenerator and an adjusted weight for the supplemental fuel. In aspects where a portion of the supplemental fuel corresponds to $H_2$, it is noted that $H_2$ has a relatively high heat of combustion per unit mass (such as grams). To account for this, an adjusted weight of supplemental fuel is defined as three times the weight of molecular hydrogen ($H_2$) in the supplemental fuel plus the weight of all other components in the supplemental fuel that have a non-zero heat of combustion.

The adjusted weight of the supplemental fuel can then be compared with the weight of coke in the regenerator, as measured based on the average weight of coke on the FCC particles entering the regenerator. In various aspects, a ratio of the adjusted weight of supplemental fuel to weight of coke in the regenerator can be 0.01 or more, or 0.1 or more. In other words, the adjusted weight of the supplemental fuel (after multiplying the weight of any $H_2$ by 3.0) can be greater than 1.0% of the weight of the coke, or greater than 10% of the weight of coke. Due to the relatively low heat of combustion for coke, this can roughly correspond to having the supplemental fuel contribute 1.5% or more of the heat, or 15% or more of the heat, that is passed into the FCC reactor from the regenerator. More generally, a ratio of the adjusted weight of supplemental fuel to the weight of coke can be 0.01 or more, or 0.05 or more, or 0.1 or more, or 0.2 or more, or 0.3 or more, or 0.5 or more. In such aspects, the ratio of adjusted weight of supplemental fuel to weight of coke can be 0.01 to 10, or 0.01 to 5.0, or 0.01 to 2.0, or 0.01 to 1.0, or 0.01 to 0.5, or 0.05 to 10, or 0.05 to 5.0, or 0.05 to 2.0, or 0.05 to 1.0, or 0.05 to 0.5, or 0.1 to 10, or 0.1 to 5.0, or 0.1 to 2.0, or 0.1 to 1.0, or 0.2 to 10, or 0.2 to 5.0, or 0.2 to 2.0, or 0.2 to 1.0, or 0.3 to 10, or 0.3 to 5.0, or 0.3 to 2.0, or 0.5 to 10, or 0.5 to 5.0, or 0.5 to 2.0.

It is noted that two or more supplemental fuels can be passed into a regenerator. In some aspects a first portion of supplemental fuel can correspond to a low carbon intensity fuel while a second portion of the supplemental fuel can correspond to a mineral fuel and/or other fuel that does not correspond to a low carbon intensity fraction. In such aspects, the adjusted weight of the low carbon intensity fraction can be compared with the weight of coke in the regenerator. In such aspects, a ratio of the adjusted weight of the low carbon intensity fraction of the supplemental fuel to the weight of coke can be 0.01 or more, or 0.05 or more, or 0.1 or more, or 0.2 or more, or 0.3 or more. In such aspects, the ratio of adjusted weight of the low carbon intensity fraction in the supplemental fuel to weight of coke can be 0.01 to 10, or 0.01 to 5.0, or 0.01 to 2.0, or 0.01 to 1.0, or 0.01 to 0.5, or 0.05 to 10, or 0.05 to 5.0, or 0.05 to 2.0, or 0.05 to 1.0, or 0.05 to 0.5, or 0.1 to 10, or 0.1 to 5.0, or 0.1 to 2.0, or 0.1 to 1.0, or 0.1 to 0.5, or 0.5 to 10, or 0.5 to 5.0, or 0.5 to 2.0, or 0.2 to 1.0, or 1.0 to 10, or 1.0 to 5.0, or 1.0 to 2.0.

One option for a supplemental fuel is to have at least a portion of the supplemental fuel (such as up to substantially all of the supplemental fuel) correspond to a bio-derived fraction. Any convenient type of bio-derived fraction can be used as a supplemental fuel. One option can be to use a biomass oil or other bio-derived fraction that could alternatively be used as part of the feed to the FCC reactor. Another option can be to use biomass particles, such as biomass that has been physically processed to reduce the size of the biomass particles to a target level, such as 1.0 cm or less. Still another option can be to use a gas derived from biomass, such as a fuel gas or other overhead gas generated during pyrolysis of biomass to form biomass oil. In some aspects, a supplemental fuel can consist essentially of one or more bio-derived fractions, so that 95% or more of the lower heating value of the supplemental fuel corresponds to the lower heating value of the one or more bio-derived fractions.

Depending on how the bio-derived fraction is formed, a bio-derived fraction used as a supplemental fuel can have a carbon intensity that approaches zero. The carbon content of the bio-derived fraction can correspond to carbon that was originally consumed from the atmosphere during biomass growth. Thus, $CO_2$ generated from combustion of a bio-derived fraction generally does not contribute to carbon intensity. If the bio-derived fraction is formed using only energy from other renewable sources, it is possible for the carbon intensity of the bio-derived fraction to be close to zero. Alternatively, to the degree that fuels having a carbon intensity are used to provide power for forming the bio-derived fraction from biomass, and/or if fuels having a carbon intensity are used to transport the bio-derived fraction, then the bio-derived fraction can have a low but non-zero carbon intensity.

It is noted that bio-derived fractions can provide advantages relative to other low carbon intensity supplemental fuels, even if the carbon intensities of two fuels are otherwise similar. For example, bio-derived fractions can be easier to store and/or transport. This is in contrast to molecular hydrogen ($H_2$), which likely would need to be generated on-site to provide sufficient $H_2$ to provide supplemental fuel to an FCC reactor in a cost-effective manner.

More generally, a low carbon intensity fuel can correspond to a fuel with life cycle assessment (LCA) $CO_2$ emissions of less than 40 metric tons of $CO_2$-eq per 100 MMBTU. It is noted that the direct $CO_2$ emissions for combustion of a mineral hydrocarbonaceous fuel are generally greater than 50 metric tons of $CO_2$ per 100 MMBTU, independent of any other contributions from extraction, transport, and/or refining of such a fuel.

Further additionally or alternately, in some aspects at least a portion of a supplemental fuel can correspond to a fuel with a lower carbon intensity than the feed to the FCC reactor. This can potentially allow a reduced carbon intensity mineral fraction to be used as a supplemental fuel. Still further additionally or alternately, in some aspects, any convenient supplemental fuel can be used in order to reduce or minimize the need to form discretionary coke.

In some aspects, 10 wt % or more of a supplemental fuel can correspond to a bio-derived fraction, or 20 wt % or more, or 30 wt % or more, such as up to having substantially all of the supplemental fuel correspond to a bio-derived fraction. In some aspects, 5.0 wt % or more of a supplemental fuel can correspond to a low carbon intensity fuel, or 10 wt % or more, or 20 wt % or more, 30 wt % or more, such as up to having substantially all of the supplemental fuel correspond to a low carbon intensity fuel. In some aspects, 70 wt % or more of a supplemental fuel can correspond to a carbon-containing fuel, or 80 wt % or more, or 90 wt % or more, or 95 wt % or more, such as up to 100 wt %.

FCC Processing Conditions—General

A variety of different types of reactor vessels can be used for performing fluid catalytic cracking. Examples of suitable reactors can include, but are not limited to, riser reactors, partial riser reactors, and reactor vessels. Generally, within the reactor, the feeds for co-processing can be contacted with a catalytic cracking catalyst under cracking conditions thereby resulting in spent catalyst particles containing carbon deposited thereon and a lower boiling product stream. The cracking conditions can be selected to achieve a target level of conversion in the reactor. The different styles of reactor can be used to perform fluid catalytic cracking under different regimes for residence time of feed within the reactor. For example, in a reactor vessel, residence times of up to 30 seconds may be appropriate. The longer residence times in a reactor vessel can be used, for example, with a lower activity catalyst to provide a target level of feed conversion while maintaining higher distillate yields and/or reducing or minimizing coke formation. In some aspects, such conditions can create problems when attempting to maintain heat balance at a target temperature (and/or at a target set of processing conditions.) By contrast, within a riser reactor, average residence times can be as short as a few seconds. Riser reactors can be used, for example, to provide a narrower distribution of residence times around the average residence time, as the riser reactor can be operated under conditions that more closely approximate laminar flow or plug flow.

In some aspects, the cracking conditions selected in order to achieve a target level of conversion can include: temperatures from 900° F. to 1100° F. (~482° C. to ~593° C.), or 900° F. to 1060° F. (~482° C. to ~571° C.), or 950° F. to 1040° F. (~510° C. to ~560° C.); hydrocarbon partial pressures from 10 to 50 psia (~70-350 kPa-a), or from 20 to 40 psia (~140-280 kPa-a); and a catalyst to feed (wt/wt) ratio from 3 to 8, or 5 to 6, where the catalyst weight can correspond to total weight of the catalyst composite. Steam may be concurrently introduced with the feed into the reaction zone. The steam may comprise up to 5 wt % of the feed. In aspects where a riser reactor is used, the FCC feed residence time in the reaction zone can be less than 5 seconds, or from 3 to 5 seconds, or from 2 to 3 seconds. In aspects where a reactor vessel is used, the average residence time for the FCC feed in the reaction zone can range from 3 seconds to 30 seconds, or 3 seconds to 15 seconds. In aspects where a partial riser reactor is used, the residence times can be intermediate to the values for a riser reactor and a reactor vessel.

Another factor for controlling the FCC reaction conditions can be the weight ratio of catalyst to oil in the reactor. Generally, the weight ratio of catalyst to oil in the reactor can range from roughly 2.0 to 15, or 2.0 to 10, or 4.0 to 15, or 4.0 to 10, or 6.0 to 15, or 6.0 to 10. In some aspects where a low catalyst to oil weight ratio is desired, the weight ratio of catalyst to oil can be 2.0 to 8.0, or 2.0 to 6.0.

Catalysts suitable for use within the FCC reactor can be fluid cracking catalysts comprising either a large-pore molecular sieve or a mixture of at least one large-pore molecular sieve catalyst and at least one medium-pore molecular sieve catalyst. Large-pore molecular sieves suitable for use herein can be any molecular sieve catalyst having an average pore diameter greater than ~0.65 nm, or greater than ~0.7 nm, which are typically used to catalytically "crack" hydrocarbon feeds. In various aspects, both the large-pore molecular sieves and the medium-pore molecular sieves used herein be selected from those molecular sieves having a crystalline tetrahedral framework oxide component. For example, the crystalline tetrahedral framework oxide component can be selected from the group consisting of zeolites, tectosilicates, tetrahedral aluminophosphates (ALPOs) and tetrahedral silicoaluminophosphates (SAPOs). Preferably, the crystalline framework oxide component of both the large-pore and medium-pore catalyst can be a zeolite. More generally, a molecular sieve can correspond to a crystalline structure having a framework type recognized by the International Zeolite Association. It should be noted that when the cracking catalyst comprises a mixture of at least one large-pore molecular sieve catalyst and at least one medium-pore molecular sieve, the large-pore component can typically be used to catalyze the breakdown of primary products from the catalytic cracking reaction into clean products such as naphtha and distillates for fuels and olefins for chemical feedstocks.

Large pore molecular sieves that are typically used in commercial FCC process units can be suitable for use herein. FCC units used commercially generally employ conventional cracking catalysts which include large-pore zeolites such as USY or REY. Additional large pore molecular sieves that can be employed in accordance with the present invention include both natural and synthetic large pore zeolites. Non-limiting examples of natural large-pore zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Non-limiting examples of synthetic large pore zeolites are zeolites X, Y, A, L. ZK-4, ZK-5, B, E, F, H, J, M, Q, T, W, Z, alpha and beta, omega, REY, and USY zeolites, as well as MSE framework materials (such as MCM-68). In some aspects, the large pore molecular sieves used herein can be selected from large pore zeolites. In such aspects, suitable large-pore zeolites for use herein can be the faujasites, particularly zeolite Y, USY, and REY.

Medium-pore size molecular sieves that are suitable for use herein include both medium pore zeolites and silicoaluminophosphates (SAPOs). Medium pore zeolites suitable for use in the practice of the present invention are described in "Atlas of Zeolite Structure Types", eds. W. H. Meier and D. H. Olson, Butterworth-Heineman, Third Edition, 1992, hereby incorporated by reference. The medium-pore size zeolites generally have an average pore diameter less than about 0.7 nm, typically from about 0.5 to about 0.7 nm and includes for example, MFI, MFS, MEL, MTW, EUO, MTT, HEU, FER, and TON structure type zeolites (IUPAC Commission of Zeolite Nomenclature). Non-limiting examples of such medium-pore size zeolites, include ZSM-5, ZSM-12, ZSM-22, ZSM-23, ZSM-34, ZSM-35, ZSM-38, ZSM-48, ZSM-50, silicalite, and silicalite 2. An example of a suitable medium pore zeolite can be ZSM-5, described (for example) in U.S. Pat. Nos. 3,702,886 and 3,770,614. Other suitable zeolites can include ZSM-11, described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. As mentioned above SAPOs, such as SAPO-11, SAPO-34, SAPO-41, and SAPO-42, described (for example) in U.S. Pat. No. 4,440,871 can also be used herein. Non-limiting examples of other medium pore molecular sieves that can be used herein include chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651 and iron aluminosilicates. All of the above patents are incorporated herein by reference.

The medium-pore size zeolites (or other molecular sieves) used herein can include "crystalline admixtures" which are thought to be the result of faults occurring within the crystal or crystalline area during the synthesis of the zeolites. Examples of crystalline admixtures of ZSM-5 and ZSM-11 can be found in U.S. Pat. No. 4,229,424, incorporated herein by reference. The crystalline admixtures are themselves medium-pore size zeolites, in contrast to physical admixtures of zeolites in which distinct crystals of crystallites of different zeolites are physically present in the same catalyst composite or hydrothermal reaction mixtures.

In some aspects, the large-pore zeolite catalysts and/or the medium-pore zeolite catalysts can be present as "self-bound" catalysts, where the catalyst does not include a separate binder. In some aspects, the large-pore and medium-pore catalysts can be present in an inorganic oxide matrix component that binds the catalyst components together so that the catalyst product can be hard enough to survive inter-particle and reactor wall collisions. The inorganic oxide matrix (or binder) can be made from an inorganic oxide sol or gel which can be dried to bind the catalyst components together. Preferably, the inorganic oxide matrix can be comprised of oxides of silicon and aluminum. It can be preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ε-alumina, κ-alumina, and ρ-alumina can be employed. Preferably, the alumina species can be an aluminum trihydroxide such as gibbsite, bayerite, nordstrandite, or doyelite. Additionally or alternately, the matrix material may contain phosphorous or aluminum phosphate. Optionally, the large-pore catalysts and medium-pore catalysts be present in the same or different catalyst particles, in the aforesaid inorganic oxide matrix.

In the FCC reactor, the cracked FCC product can be removed from the fluidized catalyst particles. Preferably this can be done with mechanical separation devices, such as an FCC cyclone. The FCC product can be removed from the reactor via an overhead line, cooled and sent to a fractionator tower for separation into various cracked hydrocarbon product streams. These product streams may include, but are not limited to, a light gas stream (generally comprising $C_4$ and lighter hydrocarbon materials), a naphtha (gasoline) stream, a distillate (diesel and/or jet fuel) steam, and other various heavier gas oil product streams. The other heavier stream or streams can include a bottoms stream.

In the FCC reactor, after removing most of the cracked FCC product through mechanical means, the majority of, and preferably substantially all of, the spent catalyst particles can be conducted to a stripping zone within the FCC reactor. The stripping zone can typically contain a dense bed (or "dense phase") of catalyst particles where stripping of volatiles takes place by use of a stripping agent such as steam. There can also be space above the stripping zone with a substantially lower catalyst density which space can be referred to as a "dilute phase". This dilute phase can be thought of as either a dilute phase of the reactor or stripper in that it will typically be at the bottom of the reactor leading to the stripper.

After stripping, the stripped catalyst particles will still have some carbon-containing compounds associated with the catalyst. Some of these carbon-containing compounds can correspond to amorphous coke, while other compounds may correspond to hydrocarbonaceous compounds that are trapped within the amorphous coke. In this discussion, all of the carbon-containing compounds and hydrocarbonaceous compounds retained on a catalyst after stripping are generally referred to as coke.

In some aspects, the majority of, and preferably substantially all of, the stripped catalyst particles are subsequently conducted to a regeneration zone wherein the spent catalyst particles are regenerated by burning coke from the spent catalyst particles in the presence of an oxygen-containing gas such as air, thus producing regenerated catalyst particles. It is noted that the oxygen-containing gas can include a higher percentage of oxygen than air, such as by using an oxygen-containing gas corresponding to air that is supplemented with oxygen from an air separation unit. It is further noted that while air is a convenient source of oxygen, any other diluent could also be used. Thus, an oxygen-containing gas corresponding to oxygen with $CO_2$ as a diluent in place of and/or in addition to $N_2$ could be used. This regeneration step restores catalyst activity and simultaneously heats the catalyst to a temperature from 1200° F. to 1400° F. (~649 to 760° C.). The majority of, and preferably substantially all of the hot regenerated catalyst particles can then be recycled to the FCC reaction zone where they contact injected FCC feed.

In some aspects, the regeneration zone can correspond to a single vessel. In other aspects, a plurality of regeneration zones and/or a plurality of vessels can be used. For example, in a 2-stage regenerator, a first regeneration stage can be operated at a lower temperature while a second stage is operated at a higher temperature but with a lower steam content. Since exposure to steam is one of the pathways to deactivation of FCC catalyst, reducing the steam content in a second, higher temperature stage can allow full coke combustion to be achieved while reducing or minimizing the amount of catalyst deactivation that occurs per pass in the regenerator.

FCC Operation Example—Low Coke Feeds and Low Coke Processing Conditions

One example of situation where a low carbon intensity supplemental fuel can be beneficial is when an FCC reaction system is being operated to target naphtha production and the selected operating conditions result in coke production that is not sufficient to maintain heat balance for the reaction system at a target operating temperature (and/or for a target set of operating conditions). In this type of example, the operating conditions are selected to provide a per pass feed conversion relative to 430° F. (221° C.) of 65 wt % or higher, or 70 wt % or higher, or 75 wt % or higher, such as up to 90 wt % or possibly still higher. Due to the nature of the feed and/or the nature of the catalyst, this level of conversion can correspond to producing an amount of coke that is less than the amount needed to maintain heat balance in the reactor. This can correspond to, for example, 6.0 wt % or less of coke relative to the weight of the feed, or 5.5 wt % or less, or 5.0 wt % or less, or 4.5 wt % or less, or 4.0 wt % or less, or 3.5 wt % or less, such as down to 1.0 wt % or possibly still lower.

In some aspects, the low amount of coke production at the processing conditions can correspond at least in part to use of a feedstock with a reduced or minimized tendency to produce coke under FCC processing conditions. A variety of feedstocks can correspond to feedstocks with a reduced or minimized tendency to generate coke. Some examples of such feedstocks include feedstocks having one or more of the following feedstock properties: a Conradson Carbon Residue (CCR) content of 10 wt % or less, or 5.0 wt % or less, such as down to 0.1 wt % or possibly still lower, as determined according to ASTM D482; a hydrogen content of 12.5 wt % or more, or 12.7 wt % or more, or 13.0 wt % or more, or 13.5 wt % or more, such as up to 14.5 wt % or possibly still higher, as determined by ASTM D4808; a total aromatics content of 45 wt % or less, or 40 wt % or less, or 35 wt % or less, or 30 wt % or less, such as down to substantially no aromatics content, as determined by ASTM D5186; a paraffins content of 30 wt % or more, or 35 wt % or more, or 40 wt % or more, such as up to 80 wt % or more or such as up to being substantially composed of paraffins, as determined by ASTM D5186; and/or a T95 distillation point of 1200° F. (649° C.) or less.

Additionally or alternately, the feedstock can correspond to a hydroprocessed feedstock. For example, the feedstock can correspond to a feedstock that has been exposed to sufficient hydrotreating conditions to reduce the sulfur content of the feedstock by 50 wt % relative to the initial sulfur content and/or to reduce the sulfur content of the feedstock to 500 wppm or less. As another example, the feedstock can correspond to a hydrocracker bottoms fraction, such as a bottoms fraction from a lubes hydrocracking process.

Further additionally or alternately, the feedstock can correspond to a feedstock that includes a content of fused aromatic rings including four or more cores of 8.0 wt % or less, or 5.0 wt % or less, or 3.5 wt % or less, or 1.5 wt % or less; and/or a content of 4+ ring aromatics of 8.0 wt % or less, or 5.0 wt % or less, or 3.5 wt % or less, or 1.5 wt % or less; and/or a combined content of 3+ ring aromatics and 4+ ring aromatics of 10 wt % or less, or 7.0 wt % or less, or 5.0 wt % or less, or 3.5 wt % or less. Such characterization of multi-ring aromatics can be performed using UV-Vis spectroscopy.

In some aspects, the low amount of coke production at the FCC processing conditions can be due at least in part to the use of catalyst with a reduced or minimized tendency to form coke. Such a catalyst can be used with a conventional FCC feed and/or with a feed that has a reduced or minimized tendency to form coke.

Various types of catalyst can have a reduced or minimized tendency to form coke. Such catalysts can include catalysts with low contents of contaminant metals; catalysts that have been strongly deactivated; and/or catalysts with limited contents of active components. Additionally or alternately, such catalysts can include catalysts that have different compositions than the catalysts that have been conventionally used for performing FCC processing. This can include catalysts with unusual contents of ZSM-5, Beta, or USY, or catalysts that include zeolites different from such typical zeolite choices.

FCC Operation Example—Processing of Low Carbon Intensity Feeds and/or Reduced Carbon Intensity Mineral Feeds Another example of a situation where a low carbon intensity supplemental fuel can be beneficial is when an FCC reaction system is used to process a feed containing a low carbon intensity feedstock (e.g., a feedstock including a bio-derived fraction) and/or a feed containing a reduced carbon intensity mineral feedstock (e.g., a feedstock including a fraction derived from a Permian shale oil).

In some aspects, a feed to an FCC reactor can include a bio-derived fraction, such as 5.0 wt % to 50 wt % of a bio-derived fraction, 10 wt % to 50 wt %, or 20 wt % to 50 wt %, or 5.0 wt % to 30 wt %, or 10 wt % to 30 wt %. In such aspects, the presence of the bio-derived fraction in the feed can provide some mitigation of the $CO_2$ produced in the regenerator, in an amount that is roughly proportional to the percentage of the bio-derived fraction in the feed. Additionally, bio-derived feeds can tend to have relatively low coke formation potential, so that a feed including a bio-derived component can have an increased likelihood of providing insufficient coke to maintain heat balance. In aspects where a feed including a bio-derived fraction results in insufficient coke make to maintain heat balance, improved mitigation of $CO_2$ can be achieved by using a low carbon intensity supplemental fuel. Even though the bio-derived fraction provides some mitigation, improved mitigation can still be achieved if a low carbon intensity supplemental fuel is used instead of modifying the conditions to make additional discretionary coke.

In aspects where the amount of the bio-derived fraction corresponds to 5.0 wt % to 25 wt % of the feed, natural gas can be used as a supplemental fuel while still providing improved mitigation of $CO_2$. When only relatively low amounts of a bio-derived fraction are available for use in a feed, the $CO_2$ production from combustion of discretionary coke will still largely correspond to discretionary coke formed from the mineral portion of the feed. Even though natural gas has substantially higher net $CO_2$ emissions that a bio-derived fraction, a reduction in net $CO_2$ emissions (based on LCA) can be achieved by using a reduced carbon intensity mineral supplemental fuel, such as natural gas. Still further benefits could also be achieved by using a bio-derived fraction both as part of the feed and as the supplemental fuel.

More generally, for feeds containing 5.0 wt % to 60 wt % of a bio-derived fraction, improved mitigation of $CO_2$ can be achieved by using a bio-derived fraction as a supplemental fuel and/or using $H_2$. For feeds containing greater than 60 wt % of a bio-derived fraction, the benefits of using a low carbon intensity supplemental fuel start to be reduced, simply because so much of the coke formed in the FCC reactor corresponds to coke derived from a bio-derived fraction. Thus, in such aspects where elevated amounts of bio-derived fractions are present in the feed to the FCC reactor, the difference between net $CO_2$ production from discretionary coke and the $CO_2$ production from using a low carbon intensity supplemental fuel can decline.

Additionally or alternately, in some aspects a feed to an FCC reactor can include a reduced carbon intensity mineral fraction, such as a vacuum gas oil derived from a Permian shale oil. Fractions derived from mineral sources such as Permian shale oil can have relatively low sulfur contents, which can enable such fractions to be used with reduced or minimized processing. This has a corresponding effect of reducing or minimizing the carbon intensity of fuels derived from such fractions. For vacuum gas oil fractions derived from such mineral sources, the sulfur content can be low enough for the fraction to be processed in an FCC unit without prior hydroprocessing. Additionally, the resulting naphtha and/or diesel boiling range fractions produced by the FCC reaction system can have low enough sulfur contents so that only modest hydroprocessing is required for use as a fuel. For such types of low carbon intensity feeds, being able to operate the FCC reaction system in a manner that reduces, minimizes, and/or mitigates $CO_2$ emissions can be beneficial for maintaining the low carbon intensity status of the resulting fuels.

In various aspects, a feed for FCC processing can include 40 wt % or more of a reduced carbon intensity mineral fraction, or 50 wt % or more, or 60 wt % or more, such as up to 100 wt %. In such aspects, the reduced carbon intensity nature of the feed can be substantially preserved by using a supplemental fuel during FCC processing, and thus reducing, minimizing, or avoiding formation of discretionary coke. In such aspects, the supplemental fuel can correspond to natural gas or a low carbon intensity fuel (e.g., bio-derived fraction). Preferably, the supplemental fuel can correspond to a low carbon intensity fuel.

FCC Operation Example—Increased Diesel Production

Another potential benefit of using a supplemental fuel can be to reduce or minimize $CO_2$ emissions when operating an FCC reaction system to produce increased amounts of distillate (e.g., diesel) fuel. Traditionally, the purpose of an FCC reaction system has been to convert heavier fractions into naphtha boiling range fuels. While an FCC system does produce some products in the diesel boiling range, conventionally such products have been referred to as light cycle oils. This is due in part to light cycle oils typically having a higher aromatics content than virgin distillate boiling range fractions.

Although historically FCC reaction units have been used for naphtha production, recent changes in fuel demand have reduced the need for naphtha boiling range fuels. As a result, it would be beneficial if the product distribution from an FCC reaction unit can be shifted to generated increased amounts of diesel fuel. Conventionally, some shifting of reaction conditions has been performed to modify selectivity for naphtha versus diesel production, but such shifting of reaction conditions has been constrained by conventional limitations on the FCC process. In particular, distillate yield is generally increased by decreasing the temperature in the FCC reactor, but such temperature decreases result in decreased conversion and decreased coke make. Conventionally, this has limited temperature reductions in the reactor so that the need for supplemental fuel is avoided.

Conventionally, in addition to avoiding the need for supplemental fuel, maintaining heat balance for an FCC reactor when attempting to increase diesel production also avoids production of excess catalytic slurry oil, which either has to be recycled or becomes a very low value product. Recycle of such catalytic slurry oil to make additional diesel has generally been undesirable, since this corresponds to a reduction in productivity for the reactor. Such recycle also results in an increase in coke make per unit of diesel fuel produced, and therefore a corresponding increase in $CO_2$ generated per unit of diesel fuel produced.

In various aspects, the conventional difficulties with increasing diesel production in an FCC unit can be reduced or minimized by using a low carbon intensity supplemental fuel. By using a low carbon intensity supplemental fuel, the excess $CO_2$ associated with increased diesel production from an FCC unit can be reduced or minimized. This can also allow substantial recycle of catalytic slurry oil to the FCC reactor without causing an undesirable increase in $CO_2$ generated per unit of diesel fuel produced.

For diesel production, an FCC reactor can be operated at a lower temperature. In some aspects, the temperature in the FCC reactor can be 900° F. to 960° F. (~482° C. to ~516° C.), or 900° F. to 940° F. (~482° C. to ~504° C.). In other aspects, still lower temperatures can be used where substantial recycle of the bottoms or catalytic slurry oil is performed. In such aspects, the temperature in the FCC reactor can be 840° F. to 940° F. (~449° C. to ~504° C.), or 840° F. to 900° F. (~449° C. to)~482° C., or 840° F. to 880° F. (~449° C. to 471° C.).

Based on the lower temperature, the amount of conversion relative to 430° F. (221° C.) can be reduced under conditions for increased diesel production. In various aspects, the conversion relative to 430° F. when operating under conditions for increased diesel production can be 10 wt % to 65 wt % of the total feed introduced into the reactor on a per pass basis, or 30 wt % to 65 wt %, or 10 wt % to 60 wt %, or 30 wt % to 60 wt %, or 10 wt % to 55 wt %, or 30 wt % to 55 wt %, or 10 wt % to 50 wt %, or 30 wt % to 50 wt %, or 10 wt % to 45 wt %, or 20 wt % to 45 wt %, or 10 wt % to 40 wt %, or 20 wt % to 40 wt %. Additionally or alternately, the conversion relative to 430° F. when operating under conditions for increased diesel production can be 10 wt % to 65 wt % of the fresh feed (excluding recycle) introduced into the reactor on a per pass basis, or 30 wt % to 65 wt %, or 10 wt % to 60 wt %, or 30 wt % to 60 wt %, or 10 wt % to 55 wt %, or 30 wt % to 55 wt %, or 10 wt % to 50 wt %, or 30 wt % to 50 wt %, or 10 wt % to 45 wt %, or 20 wt % to 45 wt %, or 10 wt % to 40 wt %, or 20 wt % to 40 wt %. The resulting yield of diesel boiling range components on a per pass basis can be 20 wt % or more relative to the total weight of the feed, or 24 wt % or more, or 28 wt % or more, such as up to 40 wt % or possibly still higher. Additionally or alternately, the yield of 343° C.+ bottoms can be 20 wt % or more, or 25 wt % or more, such as up to 30 wt % or possibly still higher. The amount of coke produced on a per pass basis can be 5.0 wt % or less relative to the total weight of the feed, or 4.0 wt % or less, or 3.0 wt % or less, such as down to 1.0 wt % or possibly still lower.

In some aspects, a portion of the liquid effluent from the FCC reactor can be recycled back to the reactor. This recycled portion can correspond to a bottoms fraction or other heavy fraction. When the recycle portion corresponds to a bottoms fraction, the fraction can also be referred to as a catalytic slurry oil. The amount of the recycle portion can correspond to 10 wt % or more of the feed into the reactor, or 20 wt % or more, such as up to 50 wt % or possibly still higher. Use of recycle can allow operating conditions to be selected with relatively low per pass conversion while achieving a higher level of net conversion.

FCC Operation Example—High Temperature, Low Catalyst to Oil Operation

Yet another potential benefit of using a supplemental fuel can be to reduce or minimize $CO_2$ emissions when operating an FCC reaction system to produce increased amounts of $C_2$-$C_4$ olefins, or increased amounts of $C_3$-$C_4$ olefins. Such light olefin production can serve as a potentially valuable source of olefins for polymer production while also generating fuels boiling range products. However, increasing olefin production tends to also result in production of additional saturated $C_2$-$C_4$ hydrocarbons while reducing coke production. This means that the yield of desired products is reduced, but additional fuel is needed (either via addition of torch oil or creation of discretionary coke) in order to maintain heat balance.

In various aspects, the conventional difficulties with increasing diesel production in an FCC unit can be reduced or minimized by using a low carbon intensity supplemental fuel. By using a low carbon intensity supplemental fuel, the low coke production that results from high temperature, low catalyst to oil operating conditions does not pose problems for maintaining heat balance.

For high temperature, low catalyst to oil ratio operation, an FCC reactor can be operated at a temperature of 525° C. or higher, or 535° C. or higher, such as up to 600° C. or possibly still higher. In such aspects, the catalyst to oil ratio can be 2.0 to 8.0, or 2.0 to 6.0. Optionally, in order to reduce or minimize production of $C_2$-$C_4$ saturated hydrocarbons while still increasing production of $C_2$-$C_4$ olefins, the reactor can be operated at reduced residence times, such as a feed residence time of 5.0 seconds or less, or 3.0 seconds or less, such as down to 1.0 seconds or possibly still less.

During high temperature, low catalyst to oil operation, the amount of coke produced on a per pass basis can be 5.0 wt % or less relative to the total weight of the feed, or 4.0 wt % or less, or 3.0 wt % or less, such as down to 1.0 wt % or possibly still lower.

Examples of Reaction System Configurations

FIG. 1 shows an example of a reaction system for co-processing of biomass oil with a vacuum gas oil boiling range feedstock for FCC processing. In FIG. 1, a feedstock 105 is processed in an FCC reaction system. In the configuration shown in FIG. 1, the FCC reaction system can include a reactor 110 plus associated separation stages, and a regenerator 130. The feedstock 105 can correspond to, for example, a vacuum gas oil boiling range fraction, a low carbon intensity mineral fraction, a bio-derived fraction, or another type of fraction that is typically processed in an FCC reactor. The reactor 110 can convert at least a portion of feedstock 105 to form various products. These products can include a $C_4$ product 112, a naphtha boiling range product 114, a light cycle oil (diesel boiling range product) 116, a heavy cycle oil (343° C.+ product) 118, and bottoms (additional 343° C.+ product) or catalytic slurry oil 119. It is noted that heavy cycle oil 118 and bottoms 119 can correspond to unconverted products relative to a conversion temperature of 221° C. In the configuration shown in FIG. 1, a portion of bottoms 119 is optionally recycled as a recycle stream 102 to reactor 110. Optionally, a recycle stream 102 can include both heavy cycle oil 118 and bottoms 119.

During operation of the reactor 110, coke can form on the catalyst or otherwise become associated with the catalyst within the reactor to form spent catalyst. This spent catalyst 137 can be withdrawn into regenerator 130 and exposed to regeneration (fluidized bed combustion) conditions in the presence of oxygen and steam 131 to form regenerated catalyst 139 and a regenerator flue gas 132. In addition to the coke on spent catalyst 137, a supplemental fuel 125 can be introduced into the regenerator 130. In the example shown in FIG. 1, the supplemental fuel 125 is introduced into the regenerator. In other aspects, supplemental fuel can be introduced into a secondary vessel associated with the regenerator (not shown), such as a catalyst heater or a pre-combustion vessel, or into the stripper section of the FCC reactor, or into a transfer conduit such as spent catalyst conduit 137 between the FCC reactor and the FCC regenerator.

Example 1—Mitigation of $CO_2$ with Supplemental Fuels

FIG. 2 shows a comparison of how a low carbon intensity supplemental fuel can substantially mitigate the $CO_2$ emissions from an FCC reaction system. In FIG. 2, data generated from FCC processing of several typical vacuum gas oils under typical operating conditions was used to generate a base case for a tuned model. The results in the first column correspond to this base case (i.e., the average over the various typical data sets). The typical results used to generate the base case correspond to operation of an FCC reaction system in heat balance without formation of discretionary coke. The remaining columns show calculations based on the tuned model for how changing the feed and/or the catalyst would alter the coke formed, along with the resulting impact on FCC $CO_2$ emissions based on how the heat balance is restored, either based on discretionary coke formation or use of various types of supplemental fuels. To generate the results in the remaining columns, changes were made to API gravity, paraffins content, aromatics content, and/or catalyst coking tendency as shown in the first four rows of the table. The model was then used to determine what the resulting coke amount would be, as well as the hydrogen content of the resulting coke. Based on this calculated coke amount, the amount of heat generated by coke combustion was determined. The amounts of the various types of supplemental fuels were then determined based on the amount of heat needed to achieve the reaction condition of the model.

As shown in FIG. 2, for the base case of operation, a conventional virgin vacuum gas oil feed was used that included roughly 18 wt % paraffins and 58 wt % aromatics. This feed resulted in production of 6.09 wt % of coke on catalyst when the FCC was operated to maximize naphtha yield using a baseline FCC catalyst. The hydrogen content of this coke was roughly 7.2 wt %. Because the reaction system is in heat balance at this operating condition for the base case feed, no supplemental fuel is used.

The next column in FIG. 2 shows calculations for the change in coke production when the conventional virgin vacuum gas oil feed is replaced with a hydrotreated vacuum gas oil feed (HDT feed in FIG. 2). It is noted that the hydrotreated feed is not derived from the same source as the conventional VGO in the first column of FIG. 2. For the hydrotreated vacuum gas oil feed, the paraffin content is 8.3 wt % while the aromatics content is 42 wt %. Because of the hydrotreatment, the CCR content of the hydrotreated feed is reduced relative to the conventional vacuum gas oil. Calculations were performed using this hydrotreated feed, but otherwise keeping the operating conditions from the base case in the first column the same.

As shown in FIG. 2, using a hydrotreated feed instead of a conventional vacuum gas oil feed would result in a reduction in coke production of roughly 10% (6.09 wt % is reduced to 5.43 wt %). This was somewhat offset by an increase in the hydrogen content of the resulting coke to roughly 8.2 wt %. However, because of the loss of coke production, some method of providing additional heat is required.

In addition to the hydrotreated feed in the second column, calculations were also performed for other combinations of feed and catalyst changes. In the third column, calculations were performed based on a vacuum gas oil derived from a shale oil fraction that corresponds to a reduced carbon intensity mineral feed. The fourth column shows the change in coke formation if a catalyst is used that has similar activity to the base case catalyst, but with a reduced tendency to form coke on the catalyst. The final column shows the change in coke formation if the catalyst with reduced coke formation is used in conjunction with the hydrotreated vacuum gas oil feed. As shown in FIG. 2, the various changes in feeds and catalysts can result in reducing the coke production by values ranging from roughly 10% to 60%, while also changing the hydrogen content of the resulting coke. This loss in coke production corresponds to a loss in heat produced in the regenerator, so that some method of providing additional heat is required in order to maintain heat balance.

The remaining rows in FIG. 2 show $CO_2$ emissions that result from different options for providing the required additional heat. One group of rows corresponds to net $CO_2$ emissions, as determined by LCA, for various types of supplemental fuels. The second group of rows corresponds to the direct $CO_2$ emissions for natural gas or coke combustion. The direct $CO_2$ emissions refer to the $CO_2$ directly generated from combustion of the fuel, without considering any other life cycle assessment contributions. For all of the $CO_2$ emissions values in FIG. 2, the $CO_2$ emission values represent combustion of the amount of a fuel required to provide the necessary heat to maintain heat balance. Thus, the $CO_2$ emissions values are a comparison of $CO_2$ emissions at constant heat generation, with the amount of fuel being allowed to vary to match the target heat amount.

For comparison, the bottom row in FIG. 2 shows the amount of direct $CO_2$ emissions that would be generated if additional discretionary coke was combusted to provide the additional heat. For this bottom row, the hydrogen content of the additional discretionary coke was assumed to be a graphitic coke. Values associated with a natural graphitic coke are shown in the bottom row. As shown in FIG. 2, due to the low heat of formation for coke, using discretionary coke to maintain heat balance results in the largest additional amount of $CO_2$ formation based on just the direct $CO_2$ emissions alone. Thus, simply avoiding combustion of discretionary coke can provide some $CO_2$ mitigation. As shown in FIG. 2, however, substantial additional gains in $CO_2$ mitigation can be achieved by using a low carbon intensity supplemental fuel.

One option for providing additional heat without using discretionary coke would be to use torch oil as a supplemental fuel, in a manner similar to how heat is added to the regenerator during startup of an FCC reaction system. Using torch oil to provide the additional heat instead of combusting discretionary coke would result in net $CO_2$ emissions (based on LCA) that are roughly 33% lower than the direct $CO_2$ emissions from combusting the amount of discretionary coke that is needed to generate the same heat.

A further improvement over torch oil can be achieved by using natural gas. Due to the high hydrogen content of natural gas, natural gas can tend to have a relatively large heating value in comparison with the amount of direct $CO_2$ that is generated. The bottom rows of FIG. 2 show a comparison of the direct $CO_2$ emissions for natural gas originating from several types of sources in comparison with coke. As shown in FIG. 2, using natural gas can substantially reduce the direct $CO_2$ emissions relative to combustion of discretionary coke. However, the direct $CO_2$ emissions from natural gas still correspond to more than 50 metric tons of $CO_2$ per 100 MMBTU. Thus, the direct $CO_2$ emissions from natural gas place a limit on how much $CO_2$ mitigation can be achieved. For example, using natural gas, a roughly 50% reduction in coke combustion by combusting natural gas instead results in a roughly 25% reduction in direct $CO_2$ emissions.

In contrast to natural gas, using a low carbon intensity supplemental fuel can provide up to 100% mitigation of $CO_2$ generation for any heat that is generated using a supplemental fuel. In FIG. 2, the rows corresponding to pyrolysis oil, hydrogen ($H_2$) formed from electrolysis based on electricity from a nuclear power plant, and hydrogen ($H_2$) formed from electrolysis based on solar electricity all correspond to low carbon intensity supplemental fuels. (Although $H_2$ can only correspond to less than 30% of the lower heating value of a supplemental fuel, the hydrogen values are shown for comparison purposes.) As shown in FIG. 2, all of the low carbon intensity supplemental fuels have LCA $CO_2$ emissions that are less than 20 metric tons of $CO_2$-eq per 100 MMBTU of energy. Due in part to the direct $CO_2$ emissions, natural gas has LCA $CO_2$-eq emissions of greater than 60 metric tons per 100 MMBTU of energy. Relative to combustion of torch oil, natural gas can provide a roughly 10%-20% improvement in net $CO_2$ emissions. By contrast, the low carbon intensity supplemental fuels shown in FIG. 2 can reduce net $CO_2$ emissions by 70% or more relative to using torch oil.

The benefits of using a low carbon intensity supplemental fuel are particularly large for biomass oils. Biomass oil can potentially be used as either a feed for the FCC reactor or as a supplemental fuel. The values in FIG. 2 illustrate the leverage that can be obtained by using biomass oil as a supplemental fuel for the regenerator. In the example shown in FIG. 2, there are two ways that a bio-derived fraction could be used to generate a 50% reduction in net $CO_2$ emissions. The first option would be to obtain sufficient biomass oil so that the feed to the FCC reactor corresponded to 50 wt % of the bio-derived fraction. By contrast, if the combination of feed, catalyst, and/or operating conditions result in production of only 3 wt % coke (out of the ~ 6 wt % needed for heat balance), the same 50% reduction in net $CO_2$ emissions can be achieved by using biomass oil (or another bio-derived fraction) as the supplemental fuel in the regenerator. Due to the relative small heating value of coke, this 50% reduction in $CO_2$ can be achieved using less than 3 wt % of the bio-derived fraction as the supplemental fuel.

FIG. 3 provides another example of how low carbon intensity supplemental fuels can mitigate $CO_2$ emissions when used to maintain heat balance. In FIG. 3, the first column corresponds to a base case FCC operation. In the base case, the reactor is operated using a conventional FCC catalyst at a temperature of 536° C. The conditions result in roughly 62 wt % conversion of the feed relative to 221° C. The operating conditions and the baseline catalyst result in production of 5.12 wt % coke, which represents the amount of coke needed for heat balance in this base case.

The second column shows calculations for how the coke production would change if a low activity catalyst is used in place of the baseline catalyst. The low activity catalyst also has a reduced tendency to make coke. To maintain conversion at 62 wt %, the temperature in the reactor would be increased to 562° C. This would result in production of 3.78 wt % coke, or roughly 25 wt % less than the base case.

The remaining rows in FIG. 3 show the net or direct $CO_2$ emissions for various choices of supplemental fuel. Similar to FIG. 2, use of a low carbon intensity supplemental fuel can provide up to substantially complete mitigation of any $CO_2$ that would be formed if either discretionary coke were used and/or if a conventional supplemental fuel was used.

Example 2—Supplemental Fuels for FCC Processing of Reduced Carbon Intensity Mineral Feedstock The following is a prophetic example. A feedstock containing primarily vacuum gas oil boiling range components and having an API gravity of 45, a paraffins content of 48 wt %, and an aromatics content of 22 wt % is used as a feed for FCC processing. The FCC reaction system includes a riser reactor. The riser reactor is operated with a temperature of 940° F. (504° C.) and an average feed residence time of ~3 seconds. The resulting coke produced on the catalyst under these conditions has a hydrogen content of 9.5 wt %.

Under these conditions, the coke that would be need to be combusted to provide sufficient heat to maintain heat balance at the specified conditions would be roughly 6.0 wt % relative to the total weight of the feed. The coke produced under these conditions corresponds to 3.6 wt %. Instead of modifying the conditions to generate discretionary coke, a biomass oil is introduced into the transfer line between the riser reactor and the regenerator. The amount of biomass oil corresponds to 2.0 wt % relative to the total weight of the feed. Because combustion of the biomass oil results in substantially no $CO_2$ emissions under an LCA calculation, the LCA carbon emissions of the FCC reactor are reduced by roughly 40% relative to modifying operating conditions to produce the needed discretionary coke. Using natural gas in place of the biomass oil would result in a reduction in LCA carbon emission of only roughly 20% relative to modifying the operating conditions to produce the needed discretionary coke.

Example 3—Mitigation of $CO_2$ During FCC Operation for Diesel Production

The following is a prophetic example. A feedstock containing primarily vacuum gas oil boiling range components and having an API gravity of 19.5, a paraffins content of 18 wt %, and an aromatics content of 58 wt % is used as a feed for FCC processing with an emphasis on production of diesel boiling range products. The FCC reaction system includes a reactor vessel. The reactor vessel is operated with a temperature of 900° F. (482° C.) and an average feed residence time of ~15 seconds in order to achieve a per pass conversion relative to 430° F. (221° C.) of roughly 45 wt %. A portion of the FCC bottoms is recycled for inclusion as part of the feed so that fresh feed corresponds to 60 wt % of the total feed. The resulting coke produced on the catalyst under these conditions has a hydrogen content of 7.5 wt %.

Under these conditions, the coke that would be need to be combusted to provide sufficient heat to maintain heat balance at the specified conditions would be 4.8 wt % relative to the total weight of the feed. The coke produced under these conditions corresponds to 2.4 wt %. Instead of modifying the conditions to generate discretionary coke, a biomass oil is introduced into the stripping section of the reactor vessel. The amount of biomass oil corresponds to 1.6 wt % relative to the total weight of the feed. Because combustion of the biomass oil results in substantially no $CO_2$ emissions under an LCA calculation, the LCA carbon emissions of the FCC reactor are reduced by roughly 50% relative to modifying operating conditions to produce the needed discretionary coke. Using natural gas in place of the biomass oil would result in a reduction in LCA carbon emission of only roughly 25% relative to modifying the operating conditions to produce the needed discretionary coke.

Example 4—Supplemental Fuels for FCC Co-Processing of Bio-Derived Fractions

The following is a prophetic example. A feed is formed including two types of feedstocks. A first feedstock contains primarily vacuum gas oil boiling range components and has an API gravity of 19.5, a paraffins content of 18 wt %, and an aromatics content of 58 wt %. A second feedstock corresponds to a biomass oil formed by pyrolysis of biomass. The feed includes roughly 25 wt % of the biomass oil. The feed is used for FCC processing. The FCC reaction system includes a riser reactor. The riser reactor is operated with a temperature of 920° F. (493° C.) and an average feed residence time of ~3 seconds. The resulting coke produced on the catalyst under these conditions has a hydrogen content of 8.0 wt %.

Under these conditions, the coke that would be need to be combusted to provide sufficient heat to maintain heat balance at the specified conditions would be roughly 6.0 wt % relative to the total weight of the feed. The coke produced under these conditions corresponds to 4.0 wt %. Instead of modifying the conditions to generate discretionary coke, natural gas is added to the regenerator as a reduced carbon intensity mineral supplemental fuel. The amount of natural gas corresponds to 1.0 wt % relative to the total weight of the feed. The life cycle GHG emissions of the FCC reactor are reduced by roughly 10% relative to using torch oil as a supplemental fuel. The life cycle emissions from using the natural gas are comparable to the life cycle emissions that would occur if operating conditions were modified to for additional discretionary coke. However, using natural gas rather than forming discretionary coke allows a greater volume of low-carbon intensity fuel products to be produced by the FCC reaction system.

Additional Embodiments—Section A

Embodiment 1. A method for operating a fluid catalytic cracking reaction system, comprising: exposing a hydrocarbonaceous feed to a catalyst in a reactor under fluid catalytic cracking conditions comprising 60 wt % or more conversion relative to 221° C. to form one or more liquid products and 6.0 wt % or less coke, the 6.0 wt % or less coke being associated with the catalyst; passing at least a portion of the catalyst and the associated coke into a regenerator; passing a supplemental fuel into the regenerator, a vessel associated with the regenerator, or a combination thereof, a ratio of an adjusted weight of a low carbon intensity fraction of the supplemental fuel to a weight of the associated coke being 0.01 or more; combusting at least a portion of the associated coke and at least a portion of the supplemental fuel to form at least heated catalyst and $CO_2$; and passing at least a portion of the heated catalyst into the reactor.

Embodiment 2. The method of Embodiment 1, wherein the low carbon intensity fraction comprises biomass oil, the biomass oil optionally comprising a heavy pyrolysis oil fraction, the heavy pyrolysis oil fraction being formed by a method comprising: separating a pyrolysis oil to form the heavy pyrolysis oil fraction and a second pyrolysis oil fraction, the heavy pyrolysis oil fraction having a T50 distillation temperature that is higher than a T90 distillation temperature of the second pyrolysis oil fraction.

Embodiment 3. The method of any of the above embodiments, wherein the low carbon intensity fraction comprises $H_2$, a lower heating value of the $H_2$ comprising 30% or less of a lower heating value of the supplemental fuel, the lower heating value of the $H_2$ optionally comprising 30% or less of a lower heating value of a fluid portion of the supplemental fuel.

Embodiment 4. The method of any of the above embodiments, wherein the ratio of an adjusted weight of a low carbon intensity fraction of the supplemental fuel to a weight of the associated coke is 0.1 or more, or wherein a ratio of an adjusted weight of the supplemental fuel to a weight of the associated coke is 0.05 or more, or a combination thereof.

Embodiment 5. The method of any of the above embodiments, wherein exposing the hydrocarbonaceous feed to the catalyst under fluid catalytic cracking conditions forms 5.0 wt % or less of coke.

Embodiment 6. The method of any of the above embodiments, wherein the hydrocarbonaceous feed comprises 25 wt % or less of a bio-derived fraction relative to a weight of the hydrocarbonaceous feed, or wherein the hydrocarbonaceous feed comprises at least a portion of a hydroprocessed feedstock, or a combination thereof.

Embodiment 7. The method of any of the above embodiments, wherein the fluid catalytic cracking conditions comprise 65 wt % or more conversion relative to 221° C.

Embodiment 8. The method of any of the above embodiments, a) wherein the hydrocarbonaceous feed comprises a T10 distillation point of 221° C. or higher; b) wherein the hydrocarbonaceous feed comprises a T50 distillation point of 343° C. or higher; c) a combination of a) and b); or d) wherein the hydrocarbonaceous feed comprises a T10 distillation point of 343° C. or higher.

Embodiment 9. The method of any of the above embodiments, wherein the fluid catalytic cracking conditions comprise a temperature of 525° C. or more and a weight ratio of catalyst to oil of 2.0 to 8.0, the fluid catalytic cracking conditions optionally comprising one or more of (or two or more of) a temperature of 535° C. or more, a weight ratio of catalyst to oil of 2.0 to 6.0, and a residence time for the hydrocarbonaceous feed under the fluid catalytic cracking conditions of 5.0 seconds or less.

Embodiment 10. The method of any of the above embodiments, wherein the supplemental fuel is passed into a stripping section of the reactor, or wherein the supplemental fuel is passed into a transfer conduit between the reactor and the regenerator, or a combination thereof.

Embodiment 11. A method for operating a fluid catalytic cracking reaction system, comprising: exposing a hydrocarbonaceous feed to a catalyst in a reactor under fluid catalytic cracking conditions comprising 20 wt % or more conversion relative to 221° C. to form one or more liquid products and coke associated with the catalyst, the hydrocarbonaceous feed comprising a T10 distillation point of 316° C. or more, a ratio of aliphatic sulfur to total sulfur of 0.15 or more, and a naphthenes to aromatics ratio of 1.0 or more; passing at least a portion of the catalyst and the associated coke into a regenerator; passing a supplemental fuel into the regenerator, a vessel associated with the regenerator, or a combination thereof, a ratio of an adjusted weight of the supplemental fuel to a weight of the associated coke being 0.01 or more; combusting at least a portion of the associated coke and at least a portion of the supplemental fuel to form at least heated catalyst and $CO_2$; and passing at least a portion of the heated catalyst into the reactor.

Embodiment 12. The method of Embodiment 11, wherein a carbon intensity of the supplemental fuel is equal to or less than a carbon intensity of the hydrocarbonaceous feed.

Embodiment 13. The method of Embodiment 11 or 12, wherein the supplemental fuel comprises natural gas.

Embodiment 14. A method for operating a fluid catalytic cracking reaction system, comprising: exposing a hydrocarbonaceous feed to a catalyst in a reactor under fluid catalytic cracking conditions comprising 20 wt % or more conversion relative to 221° C. to form one or more liquid products and coke associated with the catalyst, the hydrocarbonaceous feed comprising 25 wt % or less of a bio-derived fraction; passing at least a portion of the catalyst and the associated coke into a regenerator; passing a supplemental fuel into the regenerator, a vessel associated with the regenerator, or a combination thereof, a ratio of an adjusted weight of the supplemental fuel to a weight of the associated coke being 0.01 or more; combusting at least a portion of the associated coke and at least a portion of the supplemental fuel to form at least heated catalyst and $CO_2$; and passing at least a portion of the heated catalyst into the reactor.

Embodiment 15. The method of Embodiment 14, wherein the supplemental fuel comprises a second bio-derived fraction, the second bio-derived fraction optionally being different from the 25 wt % or less of a bio-derived fraction in the hydrocarbonaceous feed.

Embodiment 16. The method of any of Embodiments 11-15, wherein the supplemental fuel comprises a low carbon intensity fraction, a ratio of an adjusted weight of the low carbon intensity fraction of the supplemental fuel to a weight of the associated coke being 0.01 or more.

Embodiment 17. The method of any of Embodiments 11-16, wherein exposing the hydrocarbonaceous feed to the catalyst under fluid catalytic cracking conditions forms 5.0 wt % or less of coke.

Additional Embodiment A. The method of any of embodiments 1-10, wherein the low carbon intensity fuel consists essentially of one or more bio-derived fractions, or wherein the low carbon intensity fuel consists essentially of carbon-containing fuel, or a combination thereof.

Additional Embodiments—Section B

Embodiment 18. A method for operating a fluid catalytic cracking reaction system, comprising: exposing a hydrocarbonaceous feed to a catalyst in a reactor under fluid catalytic cracking conditions comprising a temperature of 535° C. or less and 20 wt % to 65 wt % conversion relative to 221° C., to form one or more liquid products and coke associated with the catalyst, the one or more liquid products comprising 25 wt % or more of a diesel boiling range fraction relative to a weight of the hydrocarbonaceous feed; passing at least a portion of the catalyst and the associated coke into a regenerator; passing a supplemental fuel into the regenerator, a vessel associated with the regenerator, or a combination thereof, a ratio of an adjusted weight of a low carbon intensity fraction of the supplemental fuel to a weight of the associated coke being 0.01 or more; combusting at least a portion of the associated coke and at least a portion of the supplemental fuel to form at least heated catalyst and $CO_2$; and passing at least a portion of the heated catalyst into the reactor.

Embodiment 19. The method of Embodiment 18, wherein the one or more liquid products comprise 20 wt % or more of a bottoms fraction relative to a weight of the hydrocarbonaceous feed, and wherein the hydrocarbonaceous feed comprises 15 wt % or more of a recycle portion of the bottoms fraction relative to the weight of the hydrocarbonaceous feed.

Embodiment 20. The method of Embodiment 18 or 19, wherein the ratio of an adjusted weight of a low carbon intensity fraction of the supplemental fuel to a weight of the associated coke is 0.1 or more, or wherein the ratio of an adjusted weight of the supplemental fuel to a weight of the associated coke is 0.05 or more, or a combination thereof.

Embodiment 21. The method of any of Embodiments 18-20, wherein the low carbon intensity fraction comprises biomass oil.

Embodiment 22. The method of any Embodiments 18-21, wherein the low carbon intensity fraction comprises $H_2$, a lower heating value of the $H_2$ comprising 30% or less of a lower heating value of the supplemental fuel, the lower heating value of the $H_2$ optionally comprising 30% or less of a lower heating value of a fluid portion of the supplemental fuel.

Embodiment 23. The method of any of Embodiments 18-22, wherein the fluid catalytic cracking conditions comprise a temperature of 504° C. or less (or 482° C. or less), or wherein the fluid catalytic cracking conditions comprise a conversion relative to 221° C. of 55 wt % or less, or a combination thereof.

Embodiment 24. The method of any of Embodiments 18-23, wherein exposing the hydrocarbonaceous feed to the catalyst under fluid catalytic cracking conditions forms 5.0 wt % or less of coke.

Embodiment 25. The method of any of Embodiments 18-24, wherein the hydrocarbonaceous feed comprises 25 wt % or less of a bio-derived fraction relative to a weight of the hydrocarbonaceous feed, or wherein the hydrocarbonaceous feed comprises at least a portion of a hydroprocessed feedstock, or a combination thereof.

Embodiment 26. The method of any of Embodiments 18-25, wherein the supplemental fuel is passed into a stripping section of the reactor, or wherein the supplemental fuel is passed into a transfer conduit between the reactor and the regenerator, or a combination thereof.

Embodiment 27. The method of any of Embodiments 18-26, wherein the fluid catalytic cracking conditions comprise a temperature of 525° C. or more and a weight ratio of catalyst to oil of 2.0 to 8.0.

Embodiment 28. A method for operating a fluid catalytic cracking reaction system, comprising: exposing a hydrocarbonaceous feed to a catalyst in a reactor under fluid catalytic cracking conditions comprising a temperature of 525° C. or higher, a weight ratio of catalyst to oil of 2.0 to 8.0, and 20 wt % to 60 wt % conversion relative to 221° C., to form one or more liquid products and coke associated with the catalyst; passing at least a portion of the catalyst and the associated coke into a regenerator; passing a supplemental fuel into the regenerator, a vessel associated with the regenerator, or a combination thereof, a ratio of an adjusted weight of a low carbon intensity fraction of the supplemental fuel to a weight of the associated coke being 0.01 or more; combusting at least a portion of the associated coke and at least a portion of the supplemental fuel to form at least heated catalyst and $CO_2$; and passing at least a portion of the heated catalyst into the reactor.

Embodiment 29. The method of Embodiment 28, wherein the one or more liquid products comprise 25 wt % or more of a diesel boiling range fraction relative to a weight of the hydrocarbonaceous feed.

Embodiment 30. The method of any of Embodiments 18-29, wherein the fluid catalytic cracking conditions comprise a temperature of 535° C. or more, or wherein the fluid catalytic cracking conditions comprise a weight ratio of catalyst to oil of 2.0 to 6.0, or a combination thereof.

Embodiment 31. The method of any of Embodiments 18-30, wherein the fluid catalytic cracking conditions further comprise a residence time for the hydrocarbonaceous feed under the fluid catalytic cracking conditions of 5.0 seconds or less.

Embodiment 32. The method of Embodiment 21, wherein the biomass oil comprises a heavy pyrolysis oil fraction, the heavy pyrolysis oil fraction being formed by a method comprising: separating a pyrolysis oil to form the heavy pyrolysis oil fraction and a second pyrolysis oil fraction, the heavy pyrolysis oil fraction having a T50 distillation temperature that is higher than a T90 distillation temperature of the second pyrolysis oil fraction.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for operating a fluid catalytic cracking reaction system, comprising:

exposing a hydrocarbonaceous feed to a catalyst in a reactor under fluid catalytic cracking conditions comprising a temperature of 535° C. or less and 20 wt % to 65 wt % conversion of compounds with boiling points of more than 221° C. to compounds with boiling points of 221° C. or less, to form one or more liquid products and coke associated with the catalyst, the one or more liquid products comprising 25 wt % or more of a diesel boiling range fraction relative to a weight of the hydrocarbonaceous feed;

passing at least a portion of the catalyst and the associated coke into a regenerator;

passing a supplemental fuel into the regenerator, a vessel associated with the regenerator, or a combination thereof, a ratio of an adjusted weight of a low carbon intensity fraction of the supplemental fuel to a weight of the associated coke being 0.01 or more;

combusting, in the regenerator, the vessel associated with the regenerator, or the combination thereof, at least a portion of the associated coke and at least a portion of the supplemental fuel to form at least heated catalyst and $CO_2$; and passing at least a portion of the heated catalyst into the reactor.

2. The method of claim 1, wherein the cracking conditions comprise 20 wt % to 60 wt % conversion of compounds with boiling points of more than 221° C. to compounds with boiling points of 221° C. or less.

3. The method of claim 1, wherein the one or more liquid products comprise 20 wt % or more of a bottoms fraction relative to a weight of the hydrocarbonaceous feed, and wherein the hydrocarbonaceous feed comprises 15 wt % or more of a recycle portion of the bottoms fraction relative to the weight of the hydrocarbonaceous feed.

4. The method of claim 1, wherein the ratio of an adjusted weight of a low carbon intensity fraction of the supplemental fuel to a weight of the associated coke is 0.1 or more.

5. The method of claim 1, wherein the ratio of an adjusted weight of the supplemental fuel to a weight of the associated coke is 0.05 or more.

6. The method of claim 1, wherein the fluid catalytic cracking conditions comprise a temperature of 504° C. or less, or wherein the fluid catalytic cracking conditions comprise a conversion of compounds with boiling points of more than 221° C. to compounds with boiling points of 221° C. or less of 55 wt % or less, or a combination thereof.

7. The method of claim 1, wherein the fluid catalytic cracking conditions comprise a temperature of 482° C. or less.

8. The method of claim 1, wherein the low carbon intensity fraction comprises biomass oil.

9. The method of claim 8, wherein the biomass oil comprises a heavy pyrolysis oil fraction, the heavy pyrolysis oil fraction being formed by a method comprising:

separating a pyrolysis oil to form the heavy pyrolysis oil fraction and a second pyrolysis oil fraction, the heavy pyrolysis oil fraction having a T50 distillation temperature that is higher than a T90 distillation temperature of the second pyrolysis oil fraction.

10. The method of claim 1, wherein the low carbon intensity fraction comprises $H_2$, a lower heating value of the $H_2$ comprising less than 30% of a lower heating value of the supplemental fuel.

11. The method of claim 1, wherein exposing the hydrocarbonaceous feed to the catalyst under fluid catalytic cracking conditions forms 5.0 wt % or less of coke.

12. The method of claim 1, wherein the supplemental fuel is passed into a stripping section of the reactor, or wherein the supplemental fuel is passed into a transfer conduit between the reactor and the regenerator, or a combination thereof.

13. The method of claim 1, wherein the hydrocarbonaceous feed comprises a T10 distillation point of 343° C. or higher.

14. The method of claim 1, wherein the hydrocarbonaceous feed comprises at least a portion of a hydroprocessed feedstock.

15. The method of claim 1, wherein the hydrocarbonaceous feed comprises a T10 distillation point of 316° C. or more, a ratio of aliphatic sulfur to total sulfur of 0.15 or more, and a naphthenes to aromatics ratio of 1.0 or more.

16. The method of claim 1, wherein the hydrocarbonaceous feed comprises 25 wt % or less of a bio-derived fraction.

17. A method for operating a fluid catalytic cracking reaction system, comprising:

exposing a hydrocarbonaceous feed to a catalyst in a reactor under fluid catalytic cracking conditions comprising a temperature of 525° C. or higher, a weight ratio of catalyst to oil of 2.0 to 8.0, and 20 wt % to 60 wt % conversion of compounds with boiling points of more than 221° C. to compounds with boiling points of 221° C. or less, to form one or more liquid products and coke associated with the catalyst;

passing at least a portion of the catalyst and the associated coke into a regenerator;

passing a supplemental fuel into the regenerator, a vessel associated with the regenerator, or a combination thereof, a ratio of an adjusted weight of a low carbon intensity fraction of the supplemental fuel to a weight of the associated coke being 0.01 or more;

combusting at least a portion of the associated coke and at least a portion of the supplemental fuel to form at least heated catalyst and $CO_2$; and passing at least a portion of the heated catalyst into the reactor.

18. The method of claim 17, wherein the one or more liquid products comprise 25 wt % or more of a diesel boiling range fraction relative to a weight of the hydrocarbonaceous feed.

19. The method of claim 17, wherein the fluid catalytic cracking conditions comprise a temperature of 535° C. or more, or wherein the fluid catalytic cracking conditions comprise a weight ratio of catalyst to oil of 2.0 to 6.0, or a combination thereof.

20. The method of claim 17, wherein the fluid catalytic cracking conditions further comprise a residence time for the hydrocarbonaceous feed under the fluid catalytic cracking conditions of 5.0 seconds or less.

* * * * *